US011308891B2

(12) United States Patent
Byun et al.

(10) Patent No.: US 11,308,891 B2
(45) Date of Patent: Apr. 19, 2022

(54) ORGANIC LIGHT EMITTING DIODE DISPLAY DEVICE IN WHICH ADJACENT SUB PIXELS SHARE A SINGLE DATA LINE AND DRIVING METHOD THEREOF WHEREIN SAME-COLORED SUB PIXELS CONTINUE TO EMIT LIGHT BASED ON A UNIT OF HORIZONTAL PERIODS

(71) Applicant: LG Display Co., Ltd., Seoul (KR)

(72) Inventors: Hyunwoo Byun, Seoul (KR); Byungchan Song, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/022,458

(22) Filed: Sep. 16, 2020

(65) Prior Publication Data

US 2021/0150990 A1 May 20, 2021

(30) Foreign Application Priority Data

Nov. 15, 2019 (KR) ..... 10-2019-0146780

(51) Int. Cl.
*G09G 3/3291* (2016.01)
*G09G 3/20* (2006.01)
*G09G 3/3258* (2016.01)

(52) U.S. Cl.
CPC ..... *G09G 3/3291* (2013.01); *G09G 3/2003* (2013.01); *G09G 3/2014* (2013.01); *G09G 3/3258* (2013.01)

(58) Field of Classification Search
None
See application file for complete search history.

(56) References Cited

U.S. PATENT DOCUMENTS

2005/0162360 A1* 7/2005 Ishihara ..... G09G 3/2081 345/89
2011/0234655 A1* 9/2011 Tzeng ..... G09G 3/3677 345/698
2014/0092145 A1* 4/2014 Park ..... G09G 3/3611 345/690
2016/0078826 A1* 3/2016 Yoo ..... G09G 3/3648 345/691
2017/0345375 A1* 11/2017 Cho ..... G09G 3/2092
2017/0345387 A1* 11/2017 Kim ..... G09G 3/2003

* cited by examiner

*Primary Examiner* — Kirk W Hermann
(74) *Attorney, Agent, or Firm* — Birch, Stewart, Kolasch & Birch, LLP

(57) ABSTRACT

Discussed is a display device including an organic light emitting diode display panel where sub pixels adjacent to each other along a direction of a gate line are paired and arranged to share a single data line. In order for the sub pixels to be driven according to a DRD method, a timing controller aligns image data and transmits the aligned image data to a data driver so that same-colored sub pixels continue to emit light based on a unit of a plurality of predetermined horizontal periods, and generates gate and data control signals and supplies the control signals to the gate and data drivers so that a predetermined driving period of the sub pixels is changed.

20 Claims, 14 Drawing Sheets

ORGANIC LIGHT EMITTING DIODE DISPLAY DEVICE IN WHICH ADJACENT SUB PIXELS SHARE A SINGLE DATA LINE AND DRIVING METHOD THEREOF WHEREIN SAME-COLORED SUB PIXELS CONTINUE TO EMIT LIGHT BASED ON A UNIT OF HORIZONTAL PERIODS

CROSS-REFERENCE TO RELATED APPLICATION

This application claims the benefit under 35 U.S.C. § 119(a) of Korean Patent Application No. 10-2019-0146780 filed on Nov. 15, 2019 in the Korean Intellectual Property Office, the entire contents of which are hereby expressly incorporated herein by reference for all purposes into the present application.

BACKGROUND

Field

The present disclosure relates to an organic light emitting diode display device and a driving method thereof that can reduce a difference in data voltage charge rates of pixels of an organic light emitting diode display panel driven according to a Double Rating Driving (DRD) method and that can improve a deterioration of image quality.

Background

Organic light emitting diode display devices can emit light on their own, and may not require an additional light source. Additionally, they are excellent in comparison to other flat panel-type image display device including a liquid crystal display device and the like in terms of brightness, contrast and viewing angles and the like. Thus, the organic light emitting diode display devices have been widely used and have been advanced as a desired flat panel-type image display device.

The organic light emitting diode display devices use a light emitting element, i.e., an organic light emitting diode where a light emitting layer is formed between a cathode that injects an electron and an anode into that injects a hole. For the organic light emitting diode display devices, the organic light emitting diode is disposed respectively in sub pixel areas of an image display panel, and the electron generated in the cathode and the hole generated in the anode of the organic light emitting diode are combined in the light emitting layer and emit light, to display an image.

For general organic light emitting diode display devices, red, green and blue color filters can be formed in each of the sub pixel areas where the organic light emitting diode is disposed, and red, green and blue sub pixels respectively emit red, green and blue light rays to display a color image.

At a time when the organic light emitting diode display devices are widely used and applied to a variety of fields, there is a growing need for finding out ways to readily apply the organic light emitting diode display devices to a wider range of fields.

SUMMARY OF THE EMBODIMENTS

In terms of organic light emitting diode display devices, there is a lack of luminance uniformity among red, green and blue sub pixels for various reasons. For example, they have different driving features due to a difference in processing of driving transistors of organic light emitting diodes formed respectively in sub pixels or due to a difference in data voltage charge rates and the like. Further, heat generated by a driving IC for controlling light emission of each sub pixel and the like can cause a deterioration of quality of a displayed image.

As a means to solve or address the above-described problems and other limitations, the present disclosure is directed to an organic light emitting diode display device and a driving method thereof that can control adjacent sub pixels configured to display the same color such that the adjacent sub pixels continue to operate, while driving an organic light emitting diode display panel according to a double rating driving (DRD) method, thereby making it possible to reduce heat generated by a driving IC and the like.

Additionally, the present disclosure is directed to an organic light emitting diode display device and a driving method thereof that can lengthen a charge period of first sub pixels in need of improvement in a charge rate among a plurality of sub pixels preconfigured to continue to display the same color at the time of the DRD driving, thereby making it possible to reduce a difference in charge rates of the sub pixels and improve a deterioration of image quality.

Aspects of the present disclosure are not limited to the above-described ones. Additionally, other aspects that have not been mentioned can be clearly understood from the following description by one having ordinary skill in the art to which the disclosure pertains.

For an organic light emitting diode display panel based on embodiments of the preset disclosure, sub pixels adjacent to each other along a direction of a gate line can be paired and arranged to share a single data line such that the sub pixels are driven according to a DRD method.

In order for the sub pixels to operate according to the DRD method, a timing controller can align image data and supply the aligned image data to a data driver so that same-colored sub pixels continue to emit light based on a unit of a plurality of predetermined horizontal periods, and can generate gate and data control signals and supply the signals to gate and data drivers so that a predetermined driving period of the sub pixels is changed.

The gate driver can change an output period of gate-on signals according to the gate control signal and can consecutively supply the same to gate lines, and the data driver can generate a data voltage to correspond to the image data aligned by the timing controller, and can output the data voltage to each data line according to the data control signal so that a supply timing of the data voltage is synchronized with a supply timing of the gate-on signals.

The timing controller based on the embodiments can align image data based on a unit of each frame and can transmit the same to the data driver to allow each of the sub pixels to operate in a driving order that changes based on a unit of at least one frame, while allowing the same-colored sub pixels, arranged along the direction of the data line, to continue to emit light based on the unit of a plurality of horizontal periods. Further, the timing controller can modulate a pulse width of a data enable signal and can generate a modulated data enable signal so that a charge period of first sub pixels in need of improvement in a charge rate among a plurality of sub pixels preconfigured to continue to display the same color is lengthened by a predetermined period.

The organic light emitting diode display device based on the embodiments can allow adjacent sub pixels, configured to display the same color, to continue to operate, while driving an organic light emitting diode display panel according to a DRD method, thereby making it possible to reduce heat generated by control circuits (e.g., gate and data driving ICs) that controls driving of gate and data lines of the organic light emitting diode display panel and improve stability of the same.

The organic light emitting diode display device based on the embodiments can control and change a driving timing of each sub pixel so that the charge period of the first sub pixels in need of improvement in a charge rate among the plurality of sub pixels preconfigured to continue to display the same color is lengthened, thereby making it possible to reduce a difference in charge rates of the sub pixels and improve a deterioration of image quality.

Advantages of the present disclosure are not limited to the above-described ones. Additionally, other advantages that have not been mentioned can be clearly understood from the following description by one having ordinary skill in the art to which the disclosure pertains.

BRIEF DESCRIPTION OF THE DRAWINGS

The accompanying drawings constitute a part of this specification, illustrate one or more embodiments of the present disclosure, and together with the specification, explain the present disclosure, wherein.

DETAILED DESCRIPTION OF THE EMBODIMENTS

Figure 1:
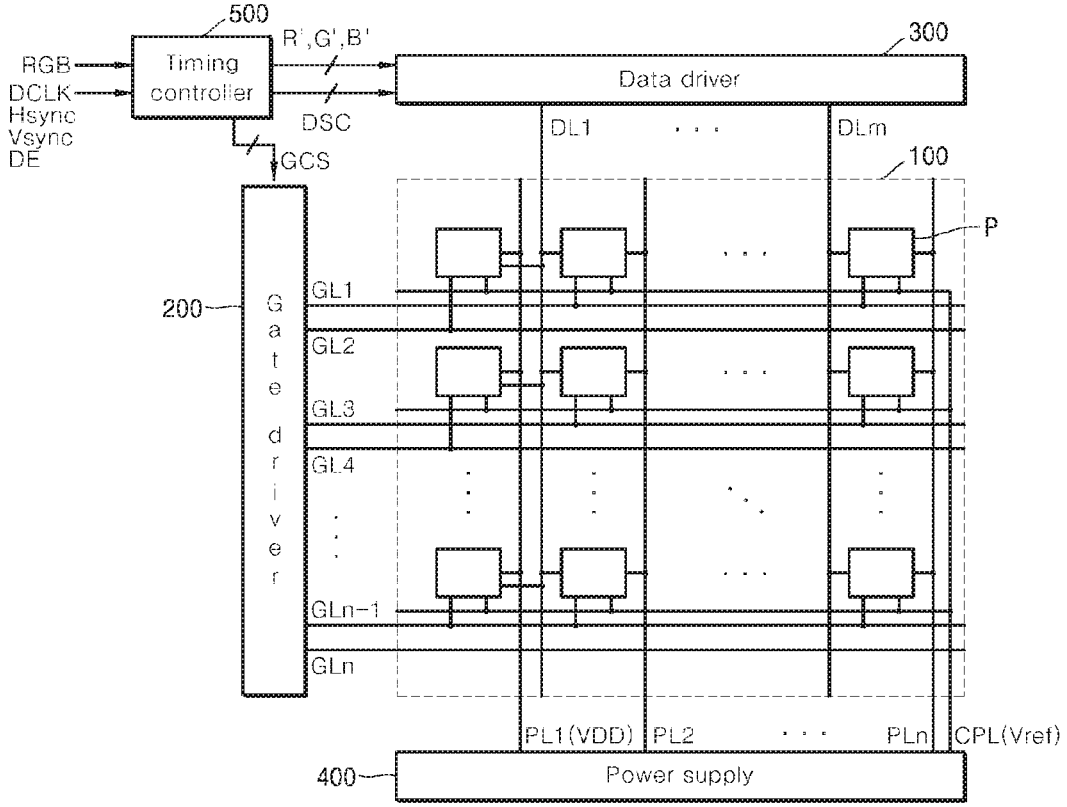
FIG. 1 is a block diagram illustrating a configuration of an organic light emitting diode display device according to an embodiment.

The above-described aspects, features and advantages are specifically described with reference to the accompanying drawings hereunder such that one having ordinary skill in the art to which the present disclosure pertains can easily implement the technical spirit of the disclosure. In describing the disclosure, detailed description of known technologies in relation to the disclosure is omitted if it is deemed to make the gist of the present disclosure unnecessarily vague. Throughout the drawings, identical reference numerals denote identical or similar components.

Below, an organic light emitting diode display device and a driving method thereof according to various embodiments of the present disclosure are described with reference to the accompanying drawings. All the components of the organic light emitting diode display device according to all embodiments of the present disclosure are operatively coupled and configured.

Figure 2:
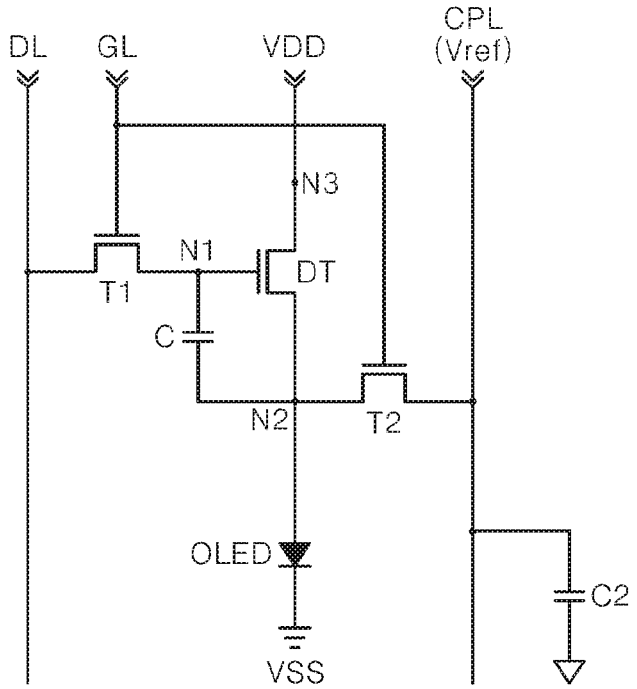
FIG. 2 is an equivalent circuit diagram of any one sub pixel in FIG. 1.

FIG. 1 is a block diagram illustrating a configuration of an organic light emitting diode display device according to an embodiment of the present disclosure, and FIG. 2 is an equivalent circuit diagram of any one sub pixel in FIG. 1.

Referring to FIG. 1, the organic light emitting diode display device according to the present disclosure can comprise an organic light emitting diode display panel 100, a gate driver 200, a data driver 300, a power supply 400 and a timing controller 500.

For the organic light emitting diode display panel 100 (referred to as "display panel"), each sub pixel (P) can be arranged in pixel areas that is defined by gate lines (GL1 to GLn) and data lines (DL1 to DLm) that are crossed, where n and m are positive numbers, e.g., positive integers. The sub pixels (P) adjacent to each other along a direction of the gate line (GL1 to GLn) can be paired and arranged to share a single data line (DL1 to DLm). A connection between the gate line (GL1 to GLn) and the data line (DL1 to DLm) and the sub pixel (P) of the display panel 100 is specifically described with reference to the accompanying drawings.

Each of the sub pixels (P) can comprise an organic light emitting diode (OLED) and a pixel circuit configured to drive the organic light emitting diode independently. Specifically, each sub pixel (P) illustrated in FIG. 2 can comprise a pixel circuit that connects to each gate line (GL), each data line (DL), and each compensation power line (CPL) and the like, and an organic light emitting diode (OLED) that is equivalently expressed as a diode and that connects between the pixel circuit and a low-potential power signal (VSS).

The pixel circuit can have a source follower-type compensation circuit structure, and can comprise first and second switching elements (T1 and T2), a first stabilization element (C), and a driving switching element (DT) and the like.

The first switching element (T1) of the pixel circuit can be switched by a gate-on signal from the gate line (GL) and can transmit a data voltage from a corresponding data line (DL) to a first node (N1) to which the driving switching element (DT) connects.

The second switching element (T2) can transmit a compensation voltage (Vref), input through the compensation power line (CPL) in response to the gate-on signal from the gate line (GL), to a second node (N2) connected with a drain terminal (or a data voltage output terminal) of the driving switching element (DT).

For the driving switching element (DT), the first node (N1) connects to a gate terminal, the second node (N2)

connects to the drain terminal, and a third node (N3) electrically connects to a source terminal (or a driving voltage input terminal). As such, the driving switching element (DT) can transmit the data voltage of the data line (DL) to the organic light emitting diode (OLED) on the basis of a data voltage input through the first node (N1) and the first stabilization element (C) and on the basis of the compensation voltage (Vref) input through the second switching element (T2) and the second node (N2).

The first stabilization element (C) can connect between the first node (N1) and the second node (N2) of the driving switching element (DT) and can hold an analogue image data voltage (referred to as "data voltage") during a single frame period.

The first stabilization element (C) can connect between the first node (N1) and the second node (N2) of the driving switching element (DT) and can hold an analogue image data voltage (referred to as "data voltage") during a single frame period.

The compensation power line (CPL) can be additionally provided with a second stabilization element (C2) for stabilizing the compensation voltage (Vref).

The timing controller 500 can align and output image data (RGB) such that same-colored sub pixels arranged along a direction of the data line (DL1 to DLm) continue to emit light on the basis of a unit of a plurality of horizontal periods while the sub pixels (P) of the display panel 100 are driven according to a double rating driving (DRD) method. The timing controller 500 can also align and output image data (RGB) to allow each of the sub pixels (P) to operate in a driving order that changes on the basis of a unit of at least one frame, while allowing the same-colored sub pixels to continue to emit light on the basis of the unit of a plurality of horizontal periods.

Further, the timing controller 500 can generate a gate control signal (GCS) and a data control signal (DSC) using synchronization signals (DCLK, DE, Hsync and Vsync) and can transmit the gate control signal (GCS) and the data control signal (DSC) respectively to the gate and data drivers 200, 300 such that the gate line (GL1 to GLn) and the data line (DL1 to DLm) of the organic light emitting diode display panel 100 are driven according to the DRD method. In this case, the timing controller 500 can generate the gate control signal (GCS) and the data control signal (DSC) such that the same-colored sub pixels (P) arranged along the direction of the data line (DL1 to DLm) continue to be driven on the basis of the unit of a plurality of horizontal periods according to the DRD method.

The timing controller 500 can modulate a pulse width of a data enable signal (DE) among the synchronization signals (DCLK, DE, Hsync and Vsync) to lengthen a charge period of first sub pixels in need of improvement in a charge rate among the plurality of sub pixels preconfigured to continue to display the same color. For example, the timing controller 500 can generate a modulated data enable signal by modulating a pulse width of the data enable signal (DE) to correspond to a driving period of the sub pixels in need of improvement in a charge rate. Additionally, the timing controller 500 can change at least one control signal of the gate control signal (GCS) and the data control signal (DSC) according to the modulated data enable signal. Features of the technologies for modulating a data enable signal (DE) and for aligning image data (RGB) of the timing controller 500 are specifically described with reference to the accompanying drawings hereunder.

The gate driver 200 can output a gate-on signal to each of the gate lines (GL1 to GLn) in an order determined according to the gate control signal (GCS).

The gate driver 200 can be provided with an internal circuit such as at least one level shifter, shift register, delay circuit, and flip flop and the like, and can consecutively generate a gate-on signal according to the gate control signal (GCS), e.g., a gate start pulse (GSP) signal, a gate shift clock (GSC) signal, a gate output enable (GOE) signal and the like. In this case, the gate driver 200 can consecutively generate a gate-on signal by shifting the GSP according to the GSC, and can supply the consecutively generated gate-on signals to each of the gate lines GL1 to GLn) on the basis of a connection of the gate lines (GL1 to GLn) of the organic light emitting diode display panel 100. An output width of the gate-on signal can be controlled according to a data enable signal (DE) the output width of which is modulated by the timing controller 500 and according to a GOE signal the output width of which is changed by the data enable signal (DE).

The gate-on signals consecutively output from the gate driver 200 are not necessarily output in an order of the arrangement of the gate lines (GL1 to GLn), and the order of the output can vary depending on a structure where a gate-on signal output channel and each gate line (GL1 to GLn) of the gate driver 200 connect. Further, the order of output of a gate-on voltage can be reset on the basis of each gate line depending on a design of an internal circuit such as a delay circuit, a flip flop and the like. During a period where the gate-on voltage is not supplied to the gate lines (GL1 to GLn), a gate-off voltage can be supplied.

The data driver 300 can consecutively receive image data (R'G'B') aligned by the timing controller 500 per at least one horizontal line.

The image data (R'G'B') aligned by the timing controller 500 can be data that are aligned such that same-colored sub pixels arranged in the direction of the data line (DL1 to DLm) continue to emit light on the basis of a unit of a plurality of horizontal periods and such that a driving order of each sub pixel (P) changes on the basis of a unit of at least one frame while all the sub pixels (P) are driven according to the DRD method.

Accordingly, the data driver 300 can convert the aligned image data (R'G'B') into an analogue data voltage per one (1) horizontal line using the data control signal (DSC), i.e., a source start pulse (SSP) signal, a source shift clock (SSC) signal, a source output enable (SOE) signal and the like.

Specifically, the data driver 300 can sample the image data (R'G'B') aligned according to an SSC signal per 1 horizontal line, can convert the same into a data voltage, and can supply the data voltage per 1 horizontal line to each data line (DL1 and DLm) in every 1 horizontal cycle where a gate-on signal is supplied to each gate line (GL1 to GLn) in response to a SOE signal the output width of which is modulated. The data voltage conversion period and the output period of the data driver 300 can be controlled and changed according to a data enable signal (DE) the output width of which is modulated by the timing controller 500 and according to an SOE signal the output width of which is changed by the data enable signal (DE). The data driver 300, as described above, can generate a data voltage such that same-colored sub pixels, arranged in the direction of the data line, continue to emit light during the plurality of horizontal periods, and can consecutively supply the data voltage to each data line (DL1 to DLm) such that the data voltage is synchronized with an output timing of the gate-on signal.

Figure 3:
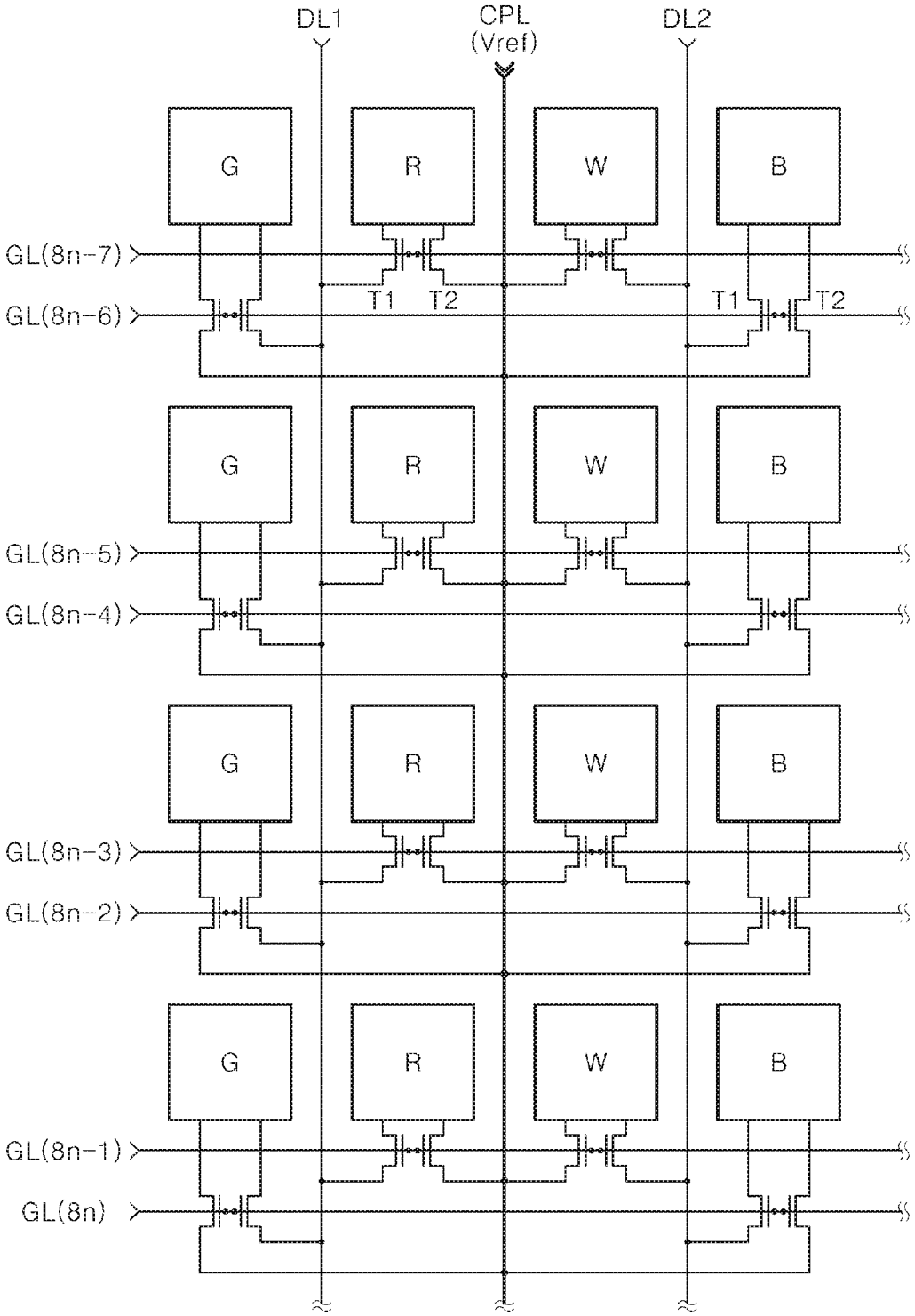
FIG. 3 is a block diagram specifically illustrating an arrangement of pixels of the organic light emitting diode display panel in FIG. 1.

FIG. 3 is a block diagram specifically illustrating an arrangement of pixels of the organic light emitting diode display panel in FIG. 1.

For the organic light emitting diode display panel 100, as illustrated in FIG. 3, the number of entire data lines (DL1 to DLm) is half the number of entire pixel columns, and the number of entire gate lines (GL1 to GLn) doubles the number of entire pixels rows. Herein, n and m can denote natural numbers except ① and can be the same natural number or different natural numbers.

Each sub pixel (P) can be disposed in a pixel area that is defined by two gate lines (e.g., $(2n-1)^{th}$ and $2n^{th}$ gate lines) and a single data line (DL) which are crossed.

For each sub pixel (P), sub pixels (P) adjacent to each other in the direction of the gate line (GL) can be paired and can share a single data line. Specifically, $(2m-1)^{th}$ data lines (DL1, DL3, . . . DLm-1), which are odd-numbered data lines, can be respectively disposed between $(4m-3)^{th}$ and $(4m-2)^{th}$ pixel columns, and pixels in the $(4m-3)^{th}$ and $(4m-2)^{th}$ pixel columns can respectively share the $(2m-1)^{th}$ data lines (DL1, DL3, . . . DLm-1) arranged therebetween.

Further, $2m^{th}$ data lines (DL2, DL4, . . . DLm), which are even-numbered data lines, can be disposed between $(4m-1)^{th}$ and $4m^{th}$ pixel columns, and pixels in the $(4m-1)^{th}$ and $4m^{th}$ pixel columns can respectively share the $2m^{th}$ data lines (DL2, DL4, . . . DLm) arranged therebetween.

Pixels adjacent to each other in a direction of the pixel columns (the data lines) can receive a gate-on signal respectively from different gate lines, and pixels in the $(4m-3)^{th}$ pixel columns and sub pixels (P) in the $4m^{th}$ pixel columns among pixels arranged in the same pixel rows (the direction of the gate lines) can be configured to receive a gate-on signal from the $2n^{th}$ gate lines closest to them (even-numbered gate lines closest to them).

Pixels in the $(4m-2)^{th}$ pixel columns and sub pixels (P) in the $(4m-1)^{th}$ pixel columns among the pixels arranged in the same pixel rows can be configured to receive a gate-on signal from the $(2n-1)^{th}$ gate lines closest to them (odd-numbered gate lines closest to them).

Figure 4:
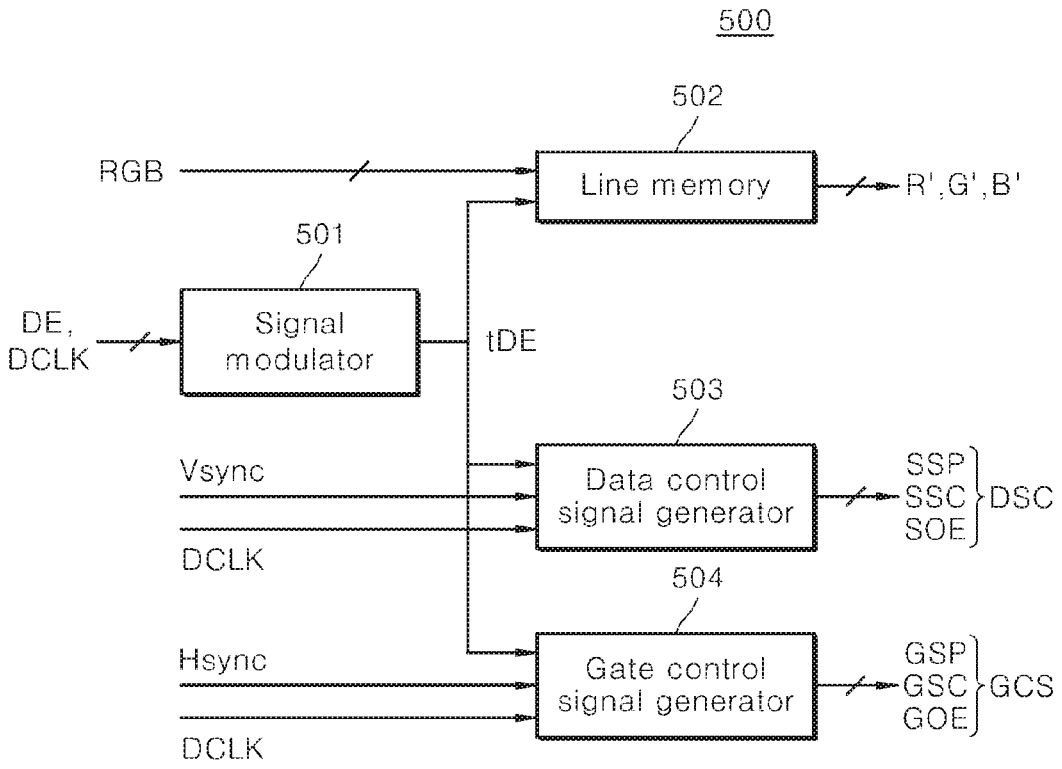
FIG. 4 is a block diagram specifically illustrating a configuration of the timing controller in FIG. 1.

FIG. 4 is a block diagram specifically illustrating a configuration of the timing controller in FIG. 1.

The timing controller 500 illustrated in FIG. 4 can comprise a signal modulator 501, a line memory 502, a data control signal generator 503, and a gate control signal generator 504.

The signal modulator 501 can modulate a pulse width of a data enable signal (DE) and can generate a modulated data enable signal (tDE) such that a charge period of first sub pixels in need of improvement in a charge rate, among a plurality of sub pixels preconfigured to continue to display the same color during the plurality of horizontal periods, is lengthened by a predetermined period. In this case, the signal modulator (501) can modulate a pulse width of a data enable signal (DE) and can generate a modulated data enable signal (tDE) such that a charge period of the rest of the sub pixels, configured to continue to display the same color, except the first sub pixels are shortened by a period that is calculated by dividing the lengthened charge period of the first sub pixels by the number of the rest of the sub pixels. Additionally, the signal modulator 501 can transmit the data enable signal (tDE) modulated and generated to the line memory 502 and the data and gate control signal generators 503, 504.

The line memory 502 can align image data (RGB) to allow the sub pixels configured to display the same color to continue to emit light on the basis of a unit of a plurality of predetermined horizontal periods and to display the same color, while allowing the plurality of sub pixels (P) to operate and to emit light according to the DRD method.

In this case, the line memory 502 can align image data (RGB) from the outside on the basis of the modulated data enable signal (tDE) such that a period, during which a data voltage is supplied to the first sub pixels in need of improvement in a charge rate among the plurality of sub pixels configured to continue to display the same color, is longer than a period during which a data voltage is supplied to the rest of the sub pixels configured to display the same color.

Specifically, the line memory 502 can also lengthen an output period of image data displayed by the first sub pixels on the basis of the modulated data enable signal (tDE) and can output the aligned image data (R'G'B') such that a charge period of the first sub pixels among the plurality of sub pixels configured to continue to display the same color is lengthened by a predetermined period.

The line memory 502 can also shorten a charge period of the rest of the sub pixels configured to continue to display the same color except the first sub pixels configured to display the same color by a period that is calculated by dividing the lengthened charge period of the first sub pixels by the number of the rest of the sub pixels and can output the aligned image data (R'G'B'). The line memory 502, as described above, can adjust the output period of the aligned image data (R'G'B') in response to the modulated data enable signal (tDE) and can consecutively transmit the aligned image data (R'G'B') to the data driver 300.

The data control signal generator 503 can generate a data control signal (DSC) using a synchronization signal including the modulated data enable signal (tDE) such that a charge period of the first sub pixels in need of improvement in a charge rate is lengthened by a predetermine period. In this case, the data control signal generator 503 can modulate an output width of an SOE signal using the data enable signal (tDE) the output width of which is modulated by the signal modulator 501 and can generate a data control signal (DSC) such that the charge period of the first sub pixels is lengthened by the predetermined period. The data control signal generator 503 can also generate and output a data control signal (DSC) such that a charge period of the rest of the sub pixels configured to continue to display the same color except the first sub pixels is shortened by a period that is calculated by dividing the lengthened charge period of the first sub pixels by the number of the rest of the sub pixels.

The gate control signal generator 504 can generate a gate control signal (GCS) such that a charge period of the first sub pixels in need of improvement in a charge rate using a synchronization signal including the modulated data enable signal (tDE) is lengthened by a predetermined period. In this case, the gate control signal generator 504 can modulate an output width of a GOE signal using the modulated data enable signal (tDE) and can generate a gate control signal (GCS) such that a period of supply of a gate-on signal of/to the first sub pixels is lengthened by the predetermined period.

The gate control signal generator 504 can generate and output a gate control signal (GCS) such that a period of supply of a gate-on signal of/to the rest of the sub pixels configured to continue to display the same color except the first sub pixels is shortened by a period that is calculated by dividing the lengthened gate-on signal supply period of the first sub pixels by the number of the rest of the sub pixels.

Figure 5:
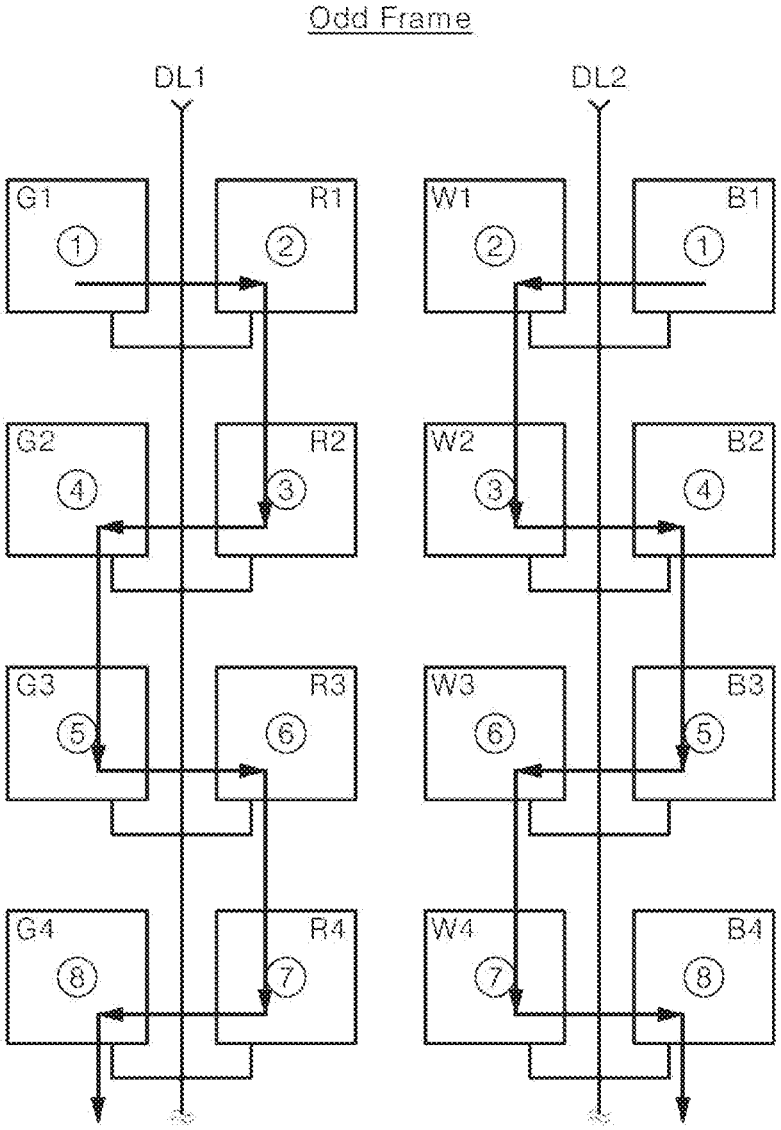
FIG. 5 is a pixel arrangement block diagram illustrating a driving order of pixels during odd-numbered frame periods according to a first embodiment.
Figure 6:
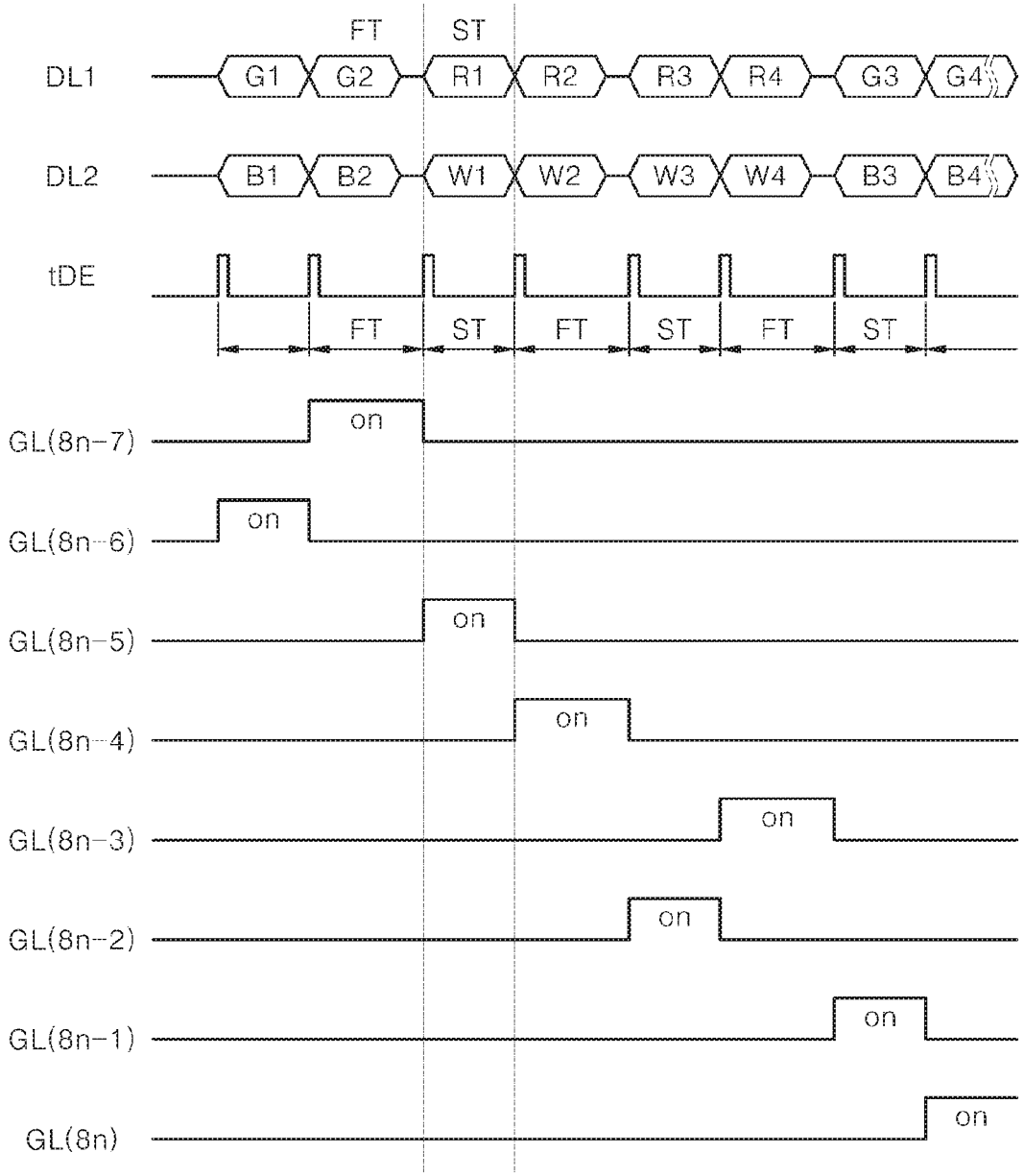
FIG. 6 is a view illustrating output timings of a modulated data enable signal and image data and a gate-on signal during the odd-numbered frame periods in FIG. 5.

FIG. 5 is a pixel arrangement block diagram illustrating a driving order of pixels during odd-numbered frame periods according to a first embodiment, and FIG. 6 is a view illustrating output timings of a modulated data enable signal and image data and a gate-on signal during the odd-numbered frame periods in FIG. 5.

Referring to FIGS. 5 and 6, the timing controller 500 can align image data such that a data voltage is supplied to pixels ① in a first pixel row of odd-numbered pixel columns ($(2m-1)^{th}$ pixel columns) and then continues to be supplied to same-colored pixels ②, ③ in first and second pixel rows of even-numbered pixel columns ($2m^{th}$ pixel columns) through odd-numbered data lines ($(2m-1)^{th}$ data lines), during the odd-numbered frame periods. Next, the timing controller 500 can align the image data such that the data voltage continues to be supplied to same-colored pixels ④, ⑤ in second and third pixel rows of the odd-numbered pixels columns ($(2m-1)^{th}$ pixel columns) and continues to be supplied again to same-colored pixels ⑥, ⑦ in third and fourth pixel rows of the even-numbered pixel columns ($2m^{th}$ pixel columns).

In this way, the timing controller 500 can align image data such that a data voltage is supplied to the first pixels ① in the odd-numbered pixel columns ($(2m-1)^{th}$ pixel columns) and then continue to be supplied alternatively to every two pixels ② ③, ④ ⑤, ⑥ ⑦ in the even-numbered pixel columns ($2m^{th}$ pixel columns) and the odd-numbered pixel columns ($(2m-1)^{th}$ pixel columns) from the even-numbered pixel columns ($2m^{th}$ pixel columns) through the odd-numbered data lines ($(2m-1)^{th}$ data lines), during the odd-numbered frame periods.

In this case, when it comes to the even-numbered data lines ($2m^{th}$ data lines), the timing controller 500 can align image data such that a data voltage is supplied to pixels ① in the first pixel row of the even-numbered pixel columns ($2m^{th}$ pixel columns) and then continues to be supplied to same-colored pixels ②, ③ in the first and second pixel rows of the odd-numbered pixel columns ($(2m-1)^{th}$ pixel columns). Next, the timing controller 500 can align the image data such that the data voltage continues to be supplied to same-colored pixels ④, ⑤ in the second and third pixel rows of the even-numbered pixel columns ($2m^{th}$ pixel columns) and continues to be supplied again to same-colored pixels ⑥, ⑦ in the third and fourth pixel rows of the odd-numbered pixel columns ($(2m-1)^{th}$ pixel columns) again.

In this way, the timing controller 500 can align image data such that a data voltage is supplied to the first pixels in the even-numbered pixel columns ($2m^{th}$ pixel columns) and then continue to be supplied alternatively to every two same-colored pixels in the odd-numbered pixel columns ($(2m-1)^{th}$ pixel columns) and the even-numbered pixel columns ($2m^{th}$ pixel columns) from the odd-numbered pixel columns ($(2m-1)^{th}$ pixel columns) when it comes to the even-numbered data lines ($2m^{th}$ data lines). The image data (R'G'B') aligned as described above can be supplied to the data driver 300 per at least 1 horizontal line.

Unlike the timing controller in FIG. 5, the timing controller 500 can operate to continue to alternatively supply a data voltage to every three same-colored pixels instead of every two same-colored pixels after the data voltage is supplied to the first pixels of the odd-numbered pixel columns ($(2m-1)^{th}$ pixel columns) of the odd-numbered data lines ($(2m-1)^{th}$ data lines) and to the first pixels of the even-numbered pixel columns ($2m^{th}$ pixel columns) of the even-numbered data lines ($2m^{th}$ data lines). However, as in FIG. 5, an example where a data voltage continues to be supplied alternatively to every two same-colored pixels is described.

Referring to FIG. 6, the timing controller 500 can generate a gate control signal (GCS) and can transmit the same to the gate driver 200 such that a gate-on voltage is supplied to the entire gate lines (GL1 to GLn) in an order of $(8n-6)^{th}$ gate lines (GL(8n−6)), $(8n-7)^{th}$ gate lines (GL(8n−7)), $(8n-5)^{th}$ gate lines (GL(8n−5)), $(8n-4)^{th}$ gate lines (GL(8n−4)), $(8n-2)^{th}$ gate lines (GL(8n−2)), $(8n-3)^{th}$ gate lines (GL(8n−3)), $(8n-1)^{th}$ gate lines (GL(8n−1)) and $8n^{th}$ gate lines (GL(8n)).

In this case, the signal modulator 501 of the timing controller 500 can generate a modulated data enable signal (tDE) and can transmit the same to the gate and data drivers 200, 300 such that a charge period (FT) of the first sub pixels ②, ④, ⑥ in need of improvement in a charge rate among every two sub pixels ②③, ④⑤, ⑥⑦ configured to continue to display the same color during a plurality of horizontal periods is lengthened by a predetermined period. The signal modulator 501 of the timing controller 500 can generate a modulated data enable signal (tDE) and can transmit the same to the gate and date drivers 200, 300 such that a charge period (ST) of the rest of the sub pixels configured to continue to display the same color is shortened by a period that is calculated by dividing the lengthened charge period (FT) of the first sub pixels by the number of the rest of the sub pixels.

Accordingly, the gate driver 200 can supply the gate-on voltage to the entire gate lines (GL1 to GLn) in the order of $(8n-6)^{th}$ gate lines (GL(8n−6)), $(8n-7)^{th}$ gate lines (GL(8n−7)), $(8n-5)^{th}$ gate lines (GL(8n−5)), $(8n-4)^{th}$ gate lines (GL(8n−4)), $(8n-2)^{th}$ gate lines (GL(8n−2)), $(8n-3)^{th}$ gate lines (GL(8n−3)), $(8n-1)^{th}$ gate lines (GL(8n−1)) and $8n^{th}$ gate lines (GL(8n)), during the odd-numbered frame periods.

Additionally, the data driver 300 can convert the image data aligned by the timing controller 500 into a data voltage per 1 horizontal line, and during the odd-numbered frame periods, can consecutively supply the data voltage to all of the odd-numbered and even-numbered data lines (DL1 to DLm) on the basis of a unit of 1 horizontal period in accordance with a timing of supply of the gate-on voltage to each gate line (GL1 to GLn).

As such, the data voltage can be supplied first to the pixels ① in the first pixel row of the odd-numbered pixel columns ($(2m-1)^{th}$ pixel columns), and then can continue to be supplied to the same-colored pixels ②, ③ in the first and second pixel rows of the even-numbered pixel columns ($2m^{th}$ pixel columns). Next, the data voltage can continue to be supplied to same-colored pixels ④, ⑤ in the second and third pixel rows of the odd-numbered pixel columns ($(2m-1)^{th}$ pixel columns), and in a way that the data voltage continues to be supplied again to the same-colored pixels ⑥, ⑦ in the third and fourth pixel rows of the even-numbered pixel columns ($2m^{th}$ pixel columns), can continue to be supplied alternatively to every two same-colored pixels ② ③, ④ ⑤, ⑥ ⑦ in the even-numbered pixel columns ($2m^{th}$ pixel columns) and the odd-numbered pixel columns ($(2m-1)^{th}$ pixel columns) from the even-numbered pixel columns ($2m^{th}$ pixel columns).

At the same time, the data voltage can be supplied first to pixels ① in the first pixel row of the even-numbered pixel columns ($2m^{th}$ pixel columns) of the even-numbered data lines ($2m^{th}$ data lines), and then can continue to be supplied to same-colored pixels ②, ③ in the first and second pixel rows of the odd-numbered pixel columns ($(2m-1)^{th}$ pixel columns). Next, the data voltage can continue to be supplied to same-colored pixels ④, ⑤ in the second and third pixel rows of the even-numbered pixel columns ($2m^{th}$ pixel columns), and in a way that the data voltage continues to be supplied again to same-colored pixels ⑥, ⑦ in the third and fourth pixel rows of the odd-numbered pixel columns ((2m−1)$^{th}$ pixel columns), can continue to be supplied alternatively to every two same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns).

As described above, the signal modulator 501 of the timing controller 500 can generate a modulated data enable signal (tDE) and can supply the same to the gate and data drivers 200, 300 such that a charge period (FT) of the first sub pixels ②, ④, ⑥ in need of improvement in a charge rate among every two sub pixels ②③, ④⑤, ⑥⑦ configured to continue to display the same color during the plurality of horizontal periods is lengthened by a predetermined period. The signal modulator 501 of the timing controller 500 can generate a modulated data enable signal (tDE) and can transmit the same to the gate and date drivers 200, 300 such that a charge period (ST) of the rest of the sub pixels configured to continue to display the same color is shortened by a period that is calculated by dividing the lengthened charge period (FT) of the first sub pixels by the number of the rest of the sub pixels. Accordingly, the signal modulator 501 of the timing controller 500 can control the charge period (FT) of the first sub pixels ②, ④, ⑥ in need of improvement in a charge rate and the charge period (ST) of the rest of the sub pixels configured to continue to display the same color such that the charge period (FT) and the charge period (ST) are changed. Description in relation to this is provided hereunder.

Figure 7:
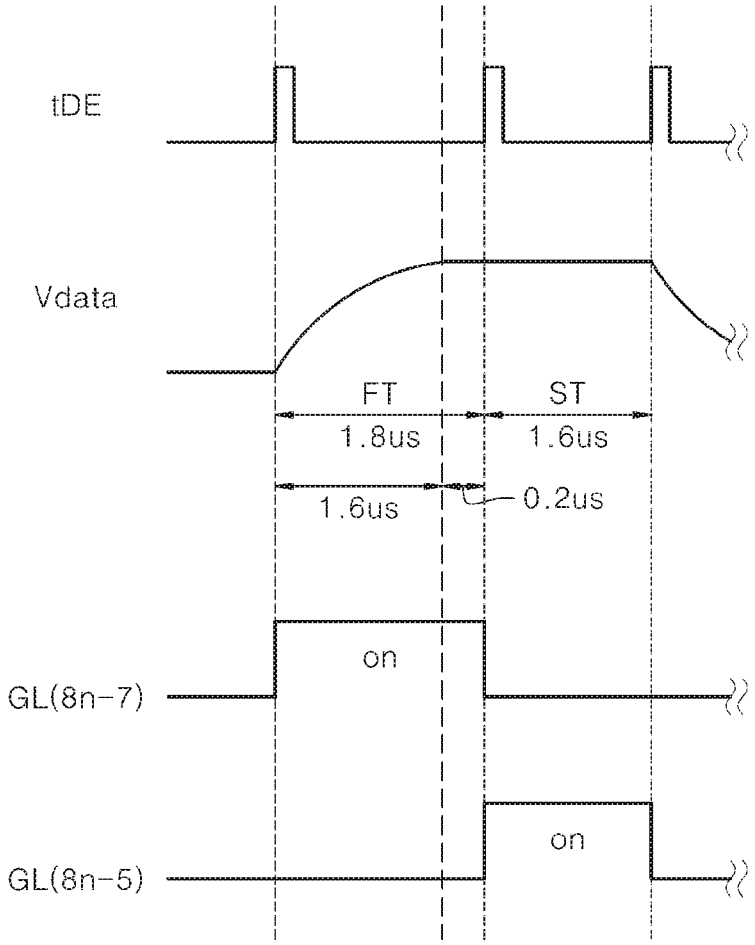
FIG. 7 is a view for describing a modulation method of the charge rate compensation pixel driving period and the same color implementation pixel driving period in FIG. 6.

FIG. 7 is a view for describing a modulation method of the charge rate compensation pixel driving period and the same color implementation pixel driving period in FIG. 6.

Referring to FIG. 7, a charge period (FT; e.g., 1.8 us) of the first sub pixels ②, ④, ⑥ in need of improvement in a charge rate among every two sub pixels ② ③, ④ ⑤, ⑥ ⑦ configured to continue to display the same color can be lengthened by a predetermined period (e.g., 0.1 us) versus predetermined 1 horizontal period (e.g., 1.7 us). Accordingly, the first sub pixels ②, ④, ⑥ in need of improvement in a charge rate can be charged by the data voltage (Vdata) during the lengthened 1 horizontal period (FT; e.g., 1.8 us).

The charge period (ST) of the rest of the sub pixels ③, ⑤, ⑦ except the first sub pixels ②, ④, ⑥ can be shortened by the lengthened charge period (e.g., 0.2 us) of the first sub pixels. Accordingly, the rest of the sub pixels ③, ⑤, ⑦ except the first sub pixels ②, ④, ⑥ can be charged by the data voltage (Vdata) during the shortened 1 horizontal period (ST; e.g., 1.6 us).

Figure 8:
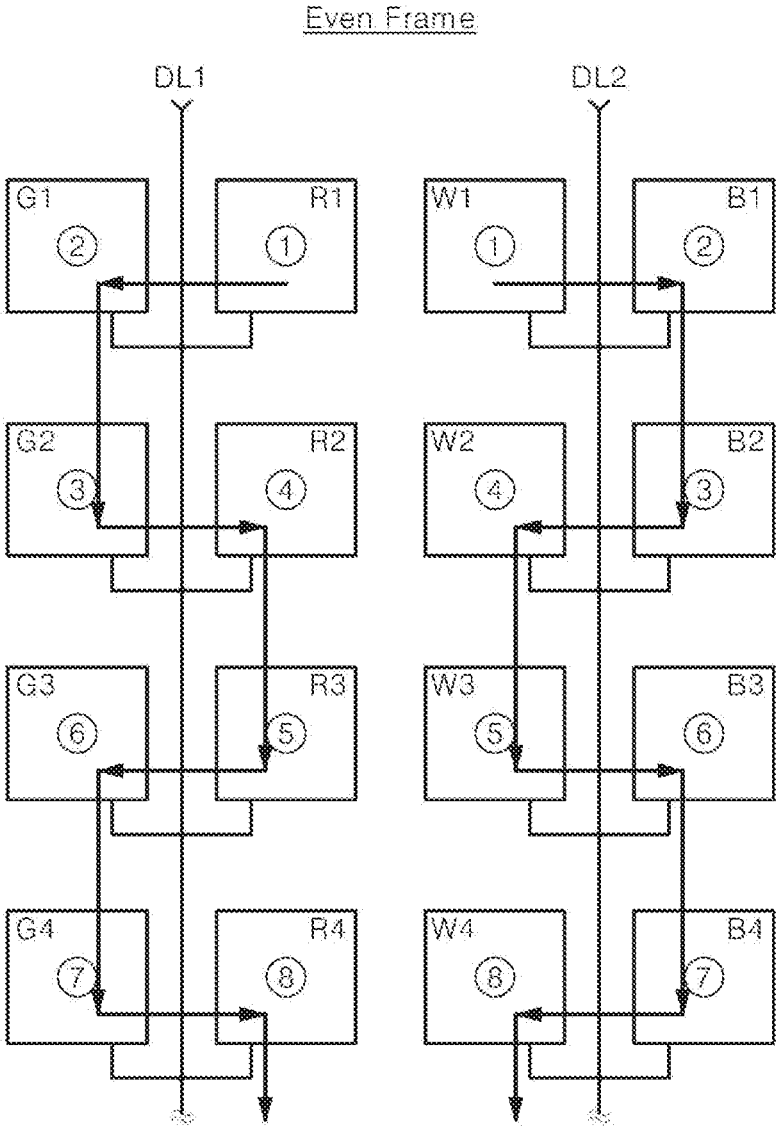
FIG. 8 is a pixel arrangement block diagram illustrating a driving order of pixels during even-numbered frame periods according to the first embodiment.

FIG. 8 is a pixel arrangement block diagram illustrating a driving order of pixels during even-numbered frame periods according to the first embodiment.

Referring to FIG. 8, unlike the timing controller in FIG. 5, the timing controller 500 can align image data such that a data voltage continues to be supplied to same-colored pixels ②, ③ in the first and second pixel rows of the odd-numbered pixel columns ((2m−1)$^{th}$ pixel columns) after the data voltage is supplied to pixels ① in the first pixel row of the even-numbered pixel columns (2m$^{th}$ pixel columns) connected to the odd-numbered data lines ((2m−1)$^{th}$ data lines), during the even-numbered frame periods. Next, the timing controller 500 can align the image data such that the data voltage continues to be supplied to same-colored pixels ④, ⑤ in the second and third pixel rows of the even-numbered pixel columns (2m$^{th}$ pixel columns) and continues to be supplied again to same-colored pixels ⑥, ⑦ in the third and fourth pixel rows of the odd-numbered pixel columns ((2m−1)$^{th}$ pixel columns).

In this way, the timing controller 500 can align image data such that a data voltage continues to be supplied alternatively to every two same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns) after the data voltage is supplied to the first pixels ① of the even-numbered pixel columns (2m$^{th}$ pixel columns), when it comes to the odd-numbered data lines ((2m−1)$^{th}$ data lines).

Additionally, the timing controller 500 can align image data such that a data voltage continues to be supplied to same-colored pixels ②, ③ in the first and second pixel rows of the even-numbered pixel columns (2m$^{th}$ pixel columns) after the data voltage is supplied to the pixels ① in the first pixel row of the odd-numbered pixel columns ((2m−1)$^{th}$ pixel columns) through the even-numbered data lines (2m$^{th}$ data lines). Next, the timing controller 500 can align the image data such that the data voltage continues to be supplied to same-colored pixels ④, ⑤ in the second and third pixel rows of the odd-numbered pixel columns ((2m−1)$^{th}$ pixel columns) and continues to be supplied again to same-colored pixels ⑥, ⑦ in the third and fourth pixel rows of the even-numbered pixel columns (2m$^{th}$ pixel columns).

In this way, the timing controller 500 can align image data such that a data voltage continues to be supplied alternatively to every two pixels ② ③, ④ ⑤, ⑥ ⑦ in the even-numbered pixel columns (2m$^{th}$ pixel columns) and the odd-numbered pixel columns ((2m−1)$^{th}$ pixel columns) from the even-numbered pixel columns (2m$^{th}$ pixel columns) after the data voltage is supplied to the first pixels ① of the odd-numbered pixel columns ((2m−1)$^{th}$ pixel columns) through the even-numbered data lines (2m$^{th}$ data lines), during the even-numbered frame periods. The image data aligned as described above can be supplied to the data driver 300 per at least 1 horizontal line.

Additionally, the timing controller 500 can generate a gate control signal (GCS) and can transmit the same to the gate driver 200 such that a gate-on voltage is consecutively supplied to the first to n$^{th}$ gate lines (GL1 to GLn) during the even-numbered frame periods.

Accordingly, the gate driver 200 can consecutively supply a gate-on voltage to the entire gate lines (GL1 to GLn) during the even-numbered frame periods.

In this case, the data driver 300 can convert the image data aligned by the timing controller 500 into a data voltage per 1 horizontal line, and during the even-numbered frame periods, can consecutively supply the data voltage to all of the odd-numbered and even-numbered data lines (DL1 to DLm) on the basis of a unit of 1 horizontal period in accordance with a timing of supply of the gate-on voltage to each gate line (GL1 to GLn).

As such, the data voltage can be supplied first to the pixels ① in the first pixel row of the even-numbered pixel columns (2m$^{th}$ pixel columns) connected to the odd-numbered data lines ((2m−1)$^{th}$ data lines), and then can continue to be supplied to the same-colored pixels ②, ③ in the first and second pixel rows of the odd-numbered pixel columns ((2m−1)$^{th}$ pixel columns). Next, the data voltage can continue to be supplied to the same-colored pixels ④, ⑤ in the second and third pixel rows of the even-numbered pixel columns (2m$^{th}$ pixel columns), and in a way that the data voltage continues to be supplied again to the same-colored pixels ⑥, ⑦ in the third and fourth pixel rows of the odd-numbered pixel columns ((2m−1)$^{th}$ pixel columns), can continue to be supplied alternatively to every two same-colored pixels in the odd-numbered pixel columns ((2m−1)$^{th}$ pixel columns) and the even-numbered pixel columns ($2m^{th}$ pixel columns) from the odd-numbered pixel columns ($(2m-1)^{th}$ pixel columns).

At the same time, the data voltage can be supplied first to the pixels ① in the first pixel row of the odd-numbered pixel columns ($(2m-1)^{th}$ pixel columns), and then can continue to be supplied to the same-colored pixels ②, ③ in the first and second pixel rows of the even-numbered pixel columns ($2m^{th}$ pixel columns). Next, the data voltage can continue to be supplied to the same-colored pixels ④, ⑤ in the second and third pixel rows of the odd-numbered pixel columns ($(2m-1)^{th}$ pixel columns), and in a way that the data voltage continues to be supplied again to the same-colored pixels ⑥, ⑦ in the third and fourth pixel rows of the even-numbered pixel columns ($2m^{th}$ pixel columns), can continue to be supplied alternatively to every two same-colored pixels ② ③, ④ ⑤, ⑥ ⑦ in the even-numbered pixel columns ($2m^{th}$ pixel columns) and the odd-numbered pixel columns ($(2m-1)^{th}$ pixel columns) from the even-numbered pixel columns ($2m^{th}$ pixel columns).

In the first embodiment of the present disclosure, a driving order of the pixels can be controlled and changed such that the pixels are driven on the basis of the unit of odd-numbered and even-numbered frame periods, while every two or three same-colored pixels arranged on the organic light emitting diode display panel 100 continue to emit light alternatively. In this case, as the same-colored pixels usually have similar gradation values, a change in data voltages supplied to each pixel through each data line (DL1 to DLm) and a data voltage charge rate difference between adjacent pixels can be reduced when the same-colored pixels continue to be driven.

Further, a driving timing of each sub pixel can be controlled and changed such that the charge period (FT) of the first sub pixels in need of improvement in a charge rate among the plurality of sub pixels preconfigured to continue to display the same color is lengthened, thereby making it possible to reduce a difference in charge rates of the sub pixels and improve a deterioration of image quality.

Figure 9:
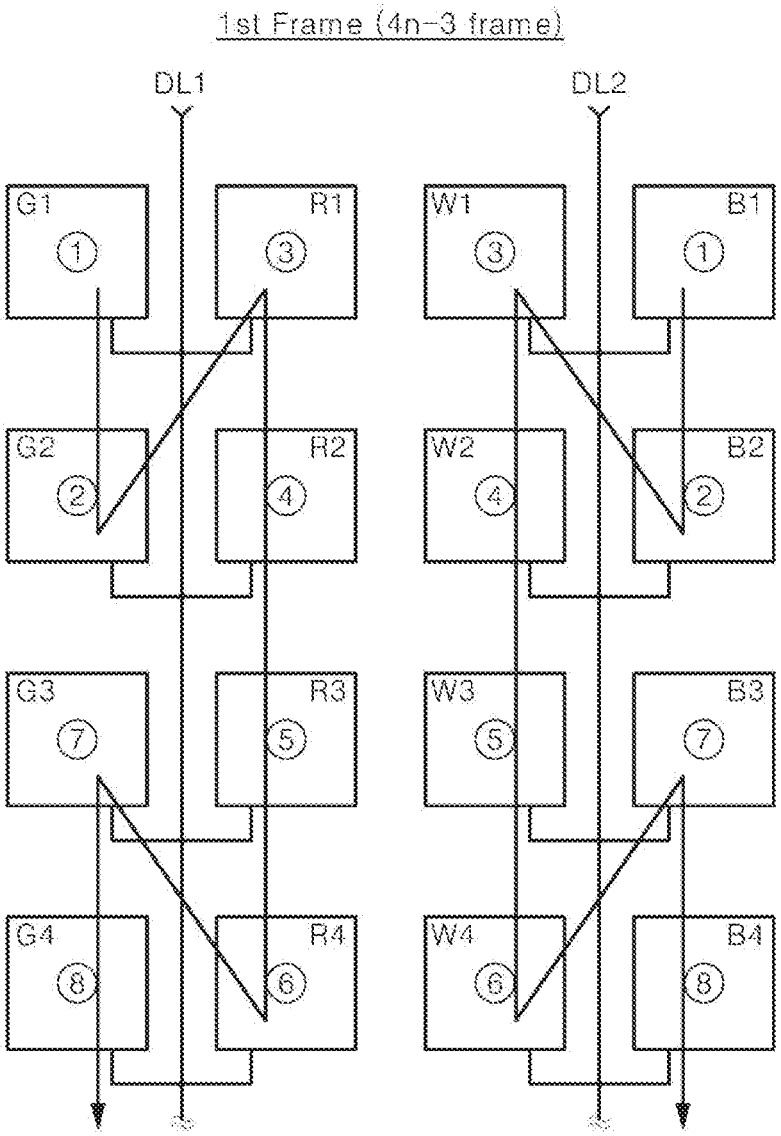
FIG. 9 is a pixel arrangement block diagram illustrating a driving order of pixels during a first frame period according to a second embodiment.
Figure 10:
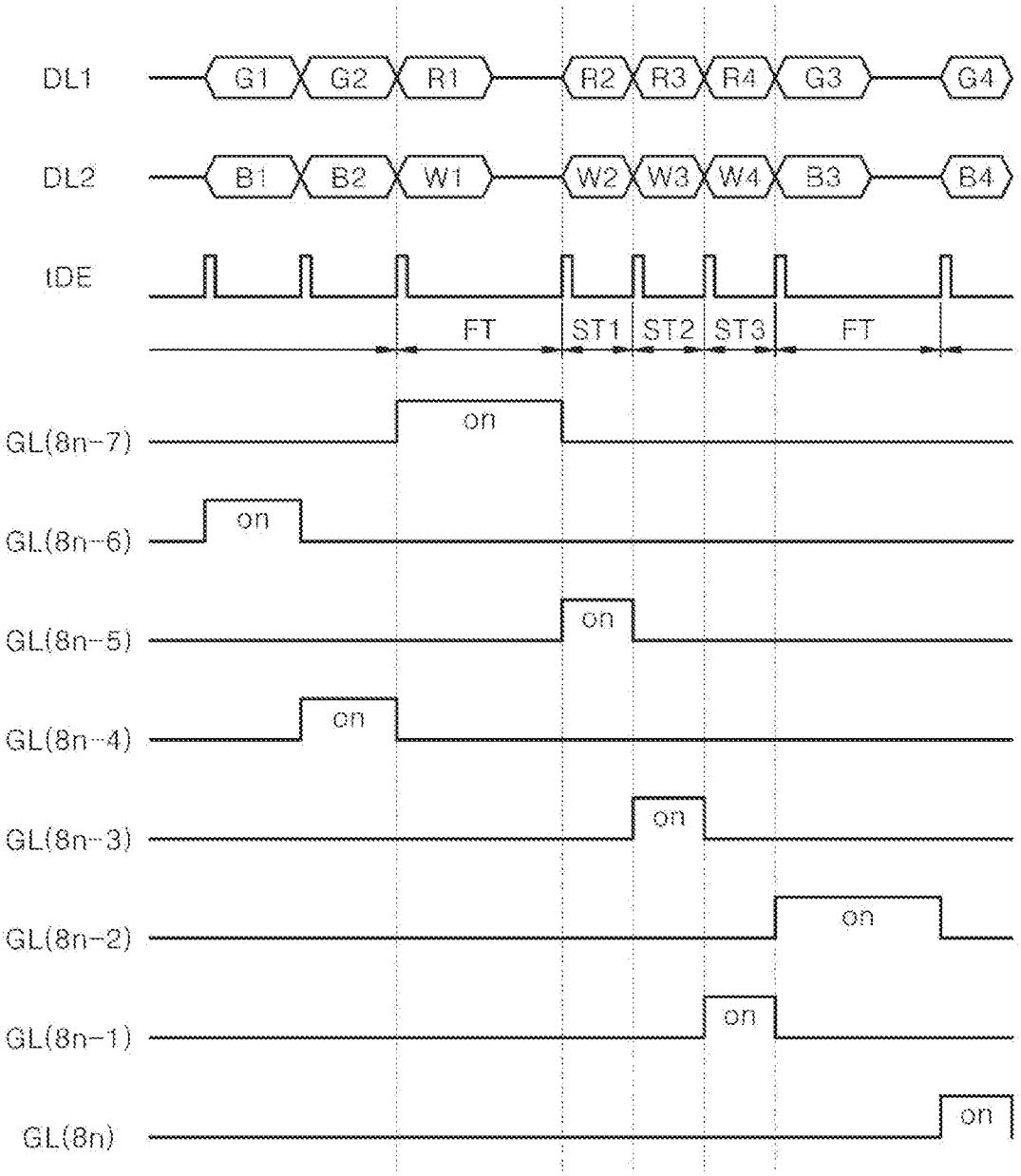
FIG. 10 is a view illustrating output timings of a modulated data enable signal and image data and a gate-on signal during the first frame period in FIG. 9.

FIG. 9 is a pixel arrangement block diagram illustrating a driving order of pixels during a first frame period according to a second embodiment, and FIG. 10 is a view illustrating output timings of a modulated data enable signal and image data and a gate-on signal during the first frame period in FIG. 9.

Referring to FIGS. 9 and 10, the timing controller 500 can align image data (RGB) such that a data voltage continues to be supplied to four same-colored pixels ③, ④, ⑤, ⑥ in the first to fourth pixel rows of the even-numbered pixel columns ($2m^{th}$ pixel columns) after the data voltage continues to be supplied to pixels ①, ② in the first and second pixel rows of the odd-numbered pixel columns ($2m-1^{th}$ pixel columns) through the odd-numbered data lines ($(2m-1)^{th}$ data lines), during the first frame period that is $(4n-3)^{th}$ frame periods. Additionally, the timing controller 500 can align the image data (RGB) such that a data voltage continues to be supplied alternatively to every four same-colored pixels in the even-numbered pixel columns ($2m^{th}$ pixel columns) and the odd-numbered pixel columns ($(2m-1)^{th}$ pixel columns) from the even-numbered pixel columns ($2m^{th}$ pixel columns) in a way that the data voltage continues to be supplied again to four same-colored pixels ⑦, ⑧ in the third to sixth pixel rows of the odd-numbered pixel columns ($(2m-1)^{th}$ pixel columns).

In this case, the timing controller 500 can align the image data (RGB) such that the data voltage continues to be supplied to four same-colored pixels ③, ④, ⑤, ⑥ in the first to fourth pixel rows of the odd-numbered pixel columns ($(2m-1)^{th}$ pixel columns) after the data voltage continues to be supplied to pixels ①, ② in the first and second pixel rows of the even-numbered pixel columns ($2m^{th}$ pixel columns) through the even-numbered data lines ($2m^{th}$ data lines). Additionally, the timing controller 500 can align the image data (RGB) such that the data voltage continues to be supplied alternatively to every four same-colored pixels in the odd-numbered pixel columns ($(2m-1)^{th}$ pixel columns) and the even-numbered pixel columns ($2m^{th}$ pixel columns) from the odd-numbered pixel columns ($(2m-1)^{th}$ pixel columns) in a way that the data voltage continues to be supplied again to four same-colored pixels ⑦, ⑧ in the third to sixth pixel rows of the even-numbered pixel columns ($2m^{th}$ pixel columns).

As illustrated in FIG. 10, the timing controller 500 can generate a gate control signal (GCS) and can transmit the same to the gate driver 200 such that a gate-on voltage is supplied to the entire gate lines (GL1 to GLn) in an order of $(8n-6)^{th}$ gate lines (GL(8n−6)), $(8n-4)^{th}$ gate lines (GL(8n−4)), $(8n-7)^{th}$ gate lines (GL(8n−7)), $(8n-5)^{th}$ gate lines (GL(8n−5)), $(8n-3)^{th}$ gate lines (GL(8n−3)), $(8n-1)^{th}$ gate lines (GL(8n−1)), $(8n-2)^{th}$ gate lines (GL(8n−2)) and $8n^{th}$ gate lines (GL(8n)).

In this case, the signal modulator 501 of the timing controller 500 can generate a modulated data enable signal (tDE) and can transmit the same to the gate and data drivers 200, 300 such that a charge period (FT) of the first sub pixels ③ in need of improvement in a charge rate among every four sub pixels ③, ④, ⑤, ⑥ configured to continue to display the same color during a plurality of horizontal periods is lengthened by a predetermined period. The signal modulator 501 of the timing controller 500 can generate a modulated data enable signal (tDE) and can transmit the same to the gate and date drivers 200, 300 such that a charge period (ST) of the rest of the sub pixels ④, ⑤, ⑥ configured to continue to display the same color is shortened by a period that is calculated by dividing the lengthened charge period (FT) of the first sub pixels ③ by the number of the rest of the sub pixels.

Accordingly, the gate driver 200 can supply a gate-on voltage to the entire gate lines (GL1 to GLn) in the order of $(8n-6)^{th}$ gate lines (GL(8n−6)), $(8n-4)^{th}$ gate lines (GL(8n−4)), $(8n-7)^{th}$ gate lines (GL(8n−7)), $(8n-5)^{th}$ gate lines (GL(8n−5)), $(8n-3)^{th}$ gate lines (GL(8n−3)), $(8n-1)^{th}$ gate lines (GL(8n−1)), $(8n-2)^{th}$ gate lines (GL(8n−2)) and $8n^{th}$ gate lines (GL(8n)), during the $(4n-3)^{th}$ frame periods.

Additionally, the data driver 300 can convert the image data aligned by the timing controller 500 into a data voltage per 1 horizontal line, and during the $(4n-3)^{th}$ frame periods, can consecutively supply the data voltage to all of the odd-numbered and even-numbered data lines (DL1 to DLm) on the basis of a unit of 1 horizontal period in accordance with a timing of supply of the gate-on voltage to each gate line (GL1 to GLn).

As such, the data voltage can continue to be supplied first to the pixels ①, ② in the first and second pixel rows of the odd-numbered pixel columns ($(2m-1)^{th}$ pixel columns) and then can continue to be supplied to the four same-colored pixels ③, ④, ⑤, ⑥ in the first to fourth pixel rows of the even-numbered pixel columns ($2m^{th}$ pixel columns) through the odd-numbered data lines ($(2m-1)^{th}$ data lines). Next, the data voltage can continue to be supplied alternatively to every four same-colored pixels in the even-numbered pixel columns ($2m^{th}$ pixel columns) and the odd-numbered pixel columns ($(2m-1)^{th}$ pixel columns) from the even-numbered pixel columns ($2m^{th}$ pixel columns) in a way that the data voltage continues to be supplied to the four same-colored pixels ⑦, ⑧ in the third to sixth pixel rows of the odd-numbered pixel columns ((2m−1)$^{th}$ pixel columns).

At the same time, the data voltage can continue to be supplied first to the pixels ①, ② in the first and second pixel rows of the even-numbered pixel columns (2m$^{th}$ pixel columns) through the even-numbered data lines (2m$^{th}$ data lines), and then can continue to be supplied to the four same-colored pixels ③, ④, ⑤, ⑥ in the first to fourth pixel rows of the odd-numbered pixel columns ((2m−1)$^{th}$ pixel columns). Additionally, the data voltage can continue to be supplied alternatively to every four same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns) in a way that the data voltage continues to be supplied again to the four same-colored pixels ⑦, ⑧ in the third to sixth pixel rows of the even-numbered pixel columns (2m$^{th}$ pixel columns).

As described above, the signal modulator 501 of the timing controller 500 can generate a modulated data enable signal (tDE) and can supply the same to the gate and data drivers 200, 300 such that a charge period (FT) of the first sub pixels ③ in need of improvement in a charge rate among every four sub pixels ③, ④, ⑤, ⑥, configured to continue to display the same color during the plurality of horizontal periods, is lengthened by a predetermined period. The signal modulator 501 of the timing controller 500 can generate a modulated data enable signal (tDE) and can transmit the same to the gate and date drivers 200, 300 such that a charge period (ST) of the rest of the sub pixels ④, ⑤, ⑥ configured to continue to display the same color is shortened by a period that is calculated by dividing the lengthened charge period (FT) of the first sub pixels by the number of the rest of the sub pixels. Accordingly, the signal modulator 501 of the timing controller 500 can control the charge period (FT) of the first sub pixels ③ in need of improvement in a charge rate and the charge period (ST) of the rest of the sub pixels configured to continue to display the same color such that the charge period (FT) and the charge period (ST) are changed. Detailed description in relation to this is provided hereunder.

Figure 11:
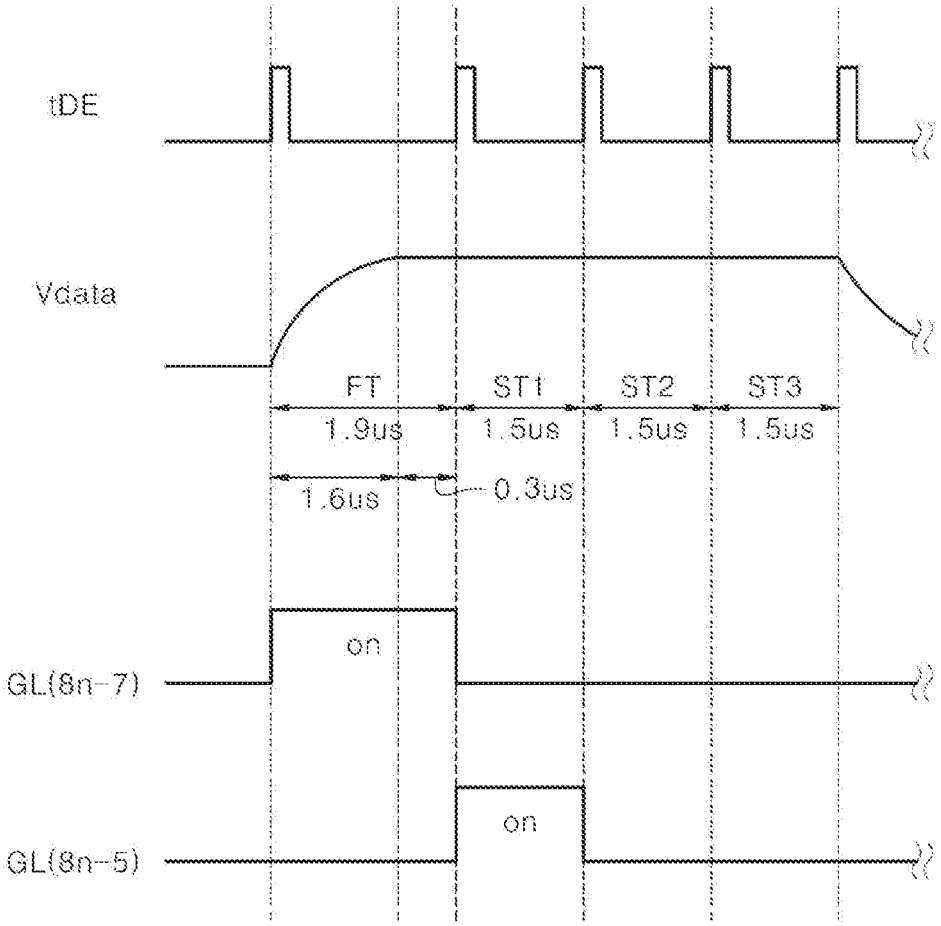
FIG. 11 is a view for describing a modulation method of the charge rate compensation pixel driving period and the same color implementation pixel driving period in FIG. 10.

FIG. 11 is a view for describing a modulation method of the charge rate compensation pixel driving period and the same color implementation pixel driving period in FIG. 10.

Referring to FIG. 11, a charge period (FT; e.g., 1.9 us) of the first sub pixels ③ 0 in need of improvement in a charge rate among every four sub pixels ③, ④, ⑤, ⑥ configured to continue to display the same color can be lengthened by a predetermined period (e.g., 0.3 us) versus predetermined 1 horizontal period (e.g., 1.6 us).

Accordingly, the first sub pixels ③ in need of improvement in a charge rate can be charged by the data voltage (Vdata) during the lengthened 1 horizontal period (FT; e.g., 1.9 us).

The charge periods (ST1, ST2 and ST3) of the rest of the sub pixels ④, ⑤, ⑥ except the first sub pixels ③ can be shortened by a period (0.3 us/3=0.1 us) that is calculated by dividing the lengthened charge period (e.g., 0.3 us) of the first sub pixels ③ by the number of the rest of the sub pixels ④, ⑤, ⑥. Accordingly, the rest of the sub pixels ④, ⑤, ⑥ except the first sub pixels ③ can be respectively charged by the data voltage (Vdata) during the shortened 1 horizontal period (ST; e.g., 1.5 us).

Figure 12:
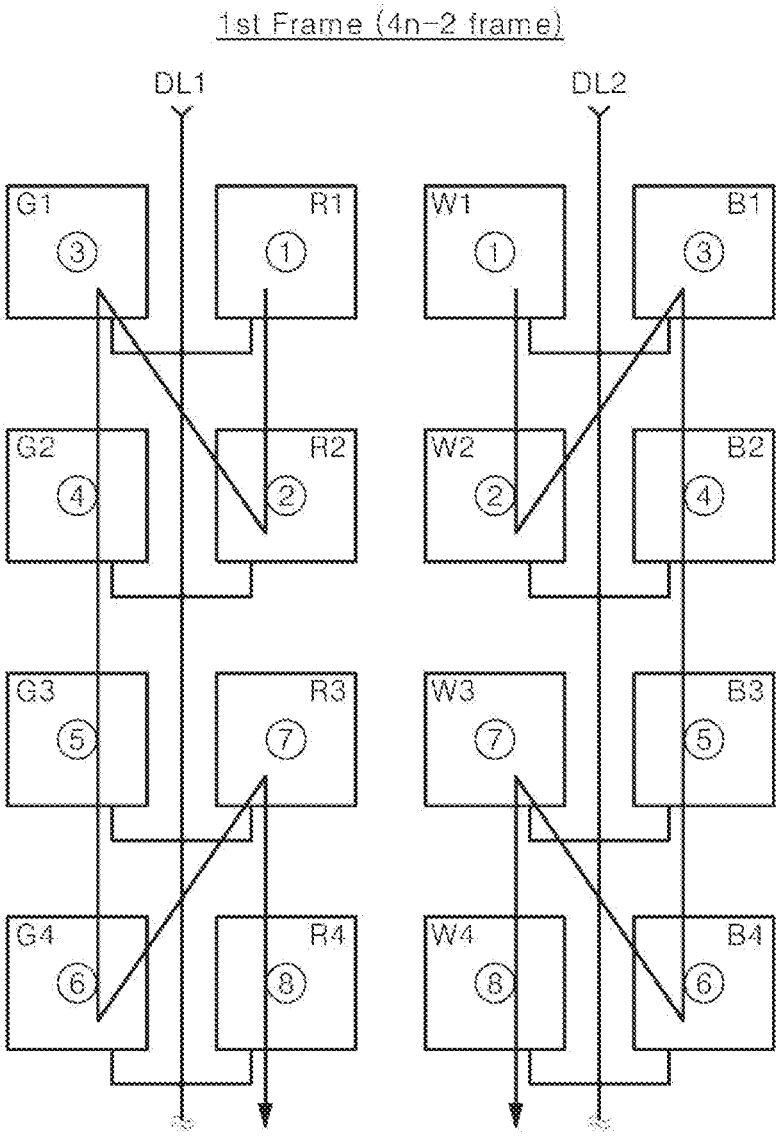
FIG. 12 is a pixel arrangement block diagram illustrating a driving order of pixels during a second frame period according to the second embodiment.

FIG. 12 is a pixel arrangement block diagram illustrating a driving order of pixels during a second frame period according to the second embodiment.

Referring to FIG. 12, unlike the timing controller in FIG. 9, the timing controller 500 can align image data (RGB) such that a data voltage continues to be supplied to four same-colored pixels ③, ④, ⑤, ⑥ in the first to four pixel rows of the odd-numbered pixel columns ((2m−1)$^{th}$ pixel columns) after the data voltage continues to be supplied to pixels ①, ② in the first and second pixel rows of the even-numbered pixel columns (2m$^{th}$ pixel columns) through the odd-numbered data lines ((2m−1)$^{th}$ data lines), during the 2n$^{d}$ frame period that is the (4n−2)$^{th}$ frame periods. Additionally, the timing controller 500 can align the image data (RGB) such that the data voltage continues to be supplied alternatively to every four same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns) in a way that the data voltage continues to be supplied again to four same-colored pixels ⑦, ⑧ in the third to the sixth pixel rows in the even-numbered pixel columns (2m$^{th}$ pixel columns).

Additionally, the timing controller 500 can align the image data (RGB) such that the data voltage continues to be supplied to four same-colored pixels ③, ④, ⑤, ⑥ in the first to fourth pixel rows of the even-numbered pixel columns (2m$^{th}$ pixel columns) after the data voltage continues to be supplied to pixels ①, ② in the first and second pixel rows of the odd-numbered pixel columns ((2m−1)$^{th}$ pixel columns) through the even-numbered data lines (2m$^{th}$ data lines). Additionally, the timing controller 500 can align the image data (RGB) such that the data voltage continues to be supplied alternatively to every four same-colored pixels in the even-numbered pixel columns (2m$^{th}$ pixel columns) and the odd-numbered pixel columns ((2m−1)$^{th}$ pixel columns) from the even-numbered pixel columns (2m$^{th}$ pixel columns) in a way that the data voltage continues to be supplied again to four same-colored pixels ⑦, ⑧ in the third to sixth pixel rows of the odd-numbered pixel columns ((2m−1)$^{th}$ pixel columns). The image data aligned as described above can be supplied to the data driver 300 per at least 1 horizontal line.

In addition, the timing controller 500, as illustrated in FIG. 12, can generate a gate control signal (GCS) and can transmit the same to the gate driver 200 such that a gate-on voltage is supplied to the entire gate lines (GL1 to GLn) in an order of (8n−7)$^{th}$ gate lines (GL(8n−7)), (8n−5)$^{th}$ gate lines (GL(8n−5)), (8n−6)$^{th}$ gate lines (GL(8n−6)), (8n−4)$^{th}$ gate lines (GL(8n−4)), (8n−2)$^{th}$ gate lines (GL(8n−2)), 8n$^{th}$ gate lines (GL(8n)), (8n−3)$^{th}$ gate lines (GL(8n−3)) and (8n−1)$^{th}$ gate lines (GL(8n−1)).

Accordingly, the gate driver 200 can supply the gate-on voltage to the entire gate lines (GL1 to GLn) in the order of (8n−7)$^{th}$ gate lines (GL(8n−7)), (8n−5)$^{th}$ gate lines (GL(8n−5)), (8n−6)$^{th}$ gate lines (GL(8n−6)), (8n−4)$^{th}$ gate lines (GL(8n−4)), (8n−2)$^{th}$ gate lines (GL(8n−2)), 8n$^{th}$ gate lines (GL(8n)), (8n−3)$^{th}$ gate lines (GL(8n−3)) and (8n−1)$^{th}$ gate lines (GL(8n−1)) during the (4n−2)$^{th}$ frame periods.

The data driver 300 can convert the image data aligned by the timing controller 500 into a data voltage per 1 horizontal line, and during the (4n−2)$^{th}$ frame periods, can consecutively supply the data voltage to all of the odd-numbered and even-numbered data lines (DL1 to DLm) on the basis of a unit of 1 horizontal period in accordance with a timing of supply of the gate-on voltage to each gate line (GL1 to GLn).

Accordingly, the data voltage continues to be supplied to the four same-colored pixels ③, ④, ⑤, ⑥ in the first to fourth pixel rows of the odd-numbered pixel columns ((2m−1)$^{th}$ pixel columns) after the data voltage continues to be supplied to the pixels ①, ② in the first and second pixel rows of the even-numbered pixel columns ($2m^{th}$ pixel columns) through the odd-numbered data lines ($(2m-1)^{th}$ data lines). Additionally, the data voltage continues to be supplied alternatively to every four same-colored pixels in the odd-numbered numbered pixel columns ($(2m-1)^{th}$ pixel columns) and the even-numbered pixel columns ($2m^{th}$ pixel columns) from the odd-numbered pixel columns ($(2m-1)^{th}$ pixel columns) in the way that the data voltage continues to be supplied again to the four same-colored pixels ⑦, ⑧ in the third to sixth pixel rows of the even-numbered pixel columns ($2m^{th}$ pixel columns).

At the same time, the data voltage continues to be supplied to the four same-colored pixels ③, ④, ⑤, ⑥ in the first to fourth pixel rows of the even-numbered pixel columns ($2m^{th}$ pixel columns) after the data voltage continues to be supplied to the pixels ①, ② in the first and second pixel rows of the odd-numbered pixel columns ($(2m-1)^{th}$ pixel columns) through the even-numbered data lines ($2m^{th}$ data lines). Next, the data voltage continues to be supplied alternatively to every four same-colored pixels in the even-numbered pixel columns ($2m^{th}$ pixel columns) and the odd-numbered pixel columns ($(2m-1)^{th}$ pixel columns) from the even-numbered pixel columns ($2m^{th}$ pixel columns) in the way that the data voltage continues to be supplied to the four same-colored pixels ⑦, ⑧ in the third to sixth pixel rows of the odd-numbered pixel columns ($(2m-1)^{th}$ pixel columns).

During the second frame period that is the $(4n-2)^{th}$ frame periods, the timing controller 500, as described above, can allow each of the pixels (P) to operate in a driving order opposite to the driving order of the pixels (P) driven during the $(4n-3)^{th}$ frame periods.

According to the second embodiment described above, a maximum of every four same-colored pixels arranged on the organic light emitting diode display panel 100 can alternatively continue to emit light, and the driving order of the pixels can be changed on the basis of a unit of odd and even-numbered frame periods such that the pixels are driven.

Figure 13:
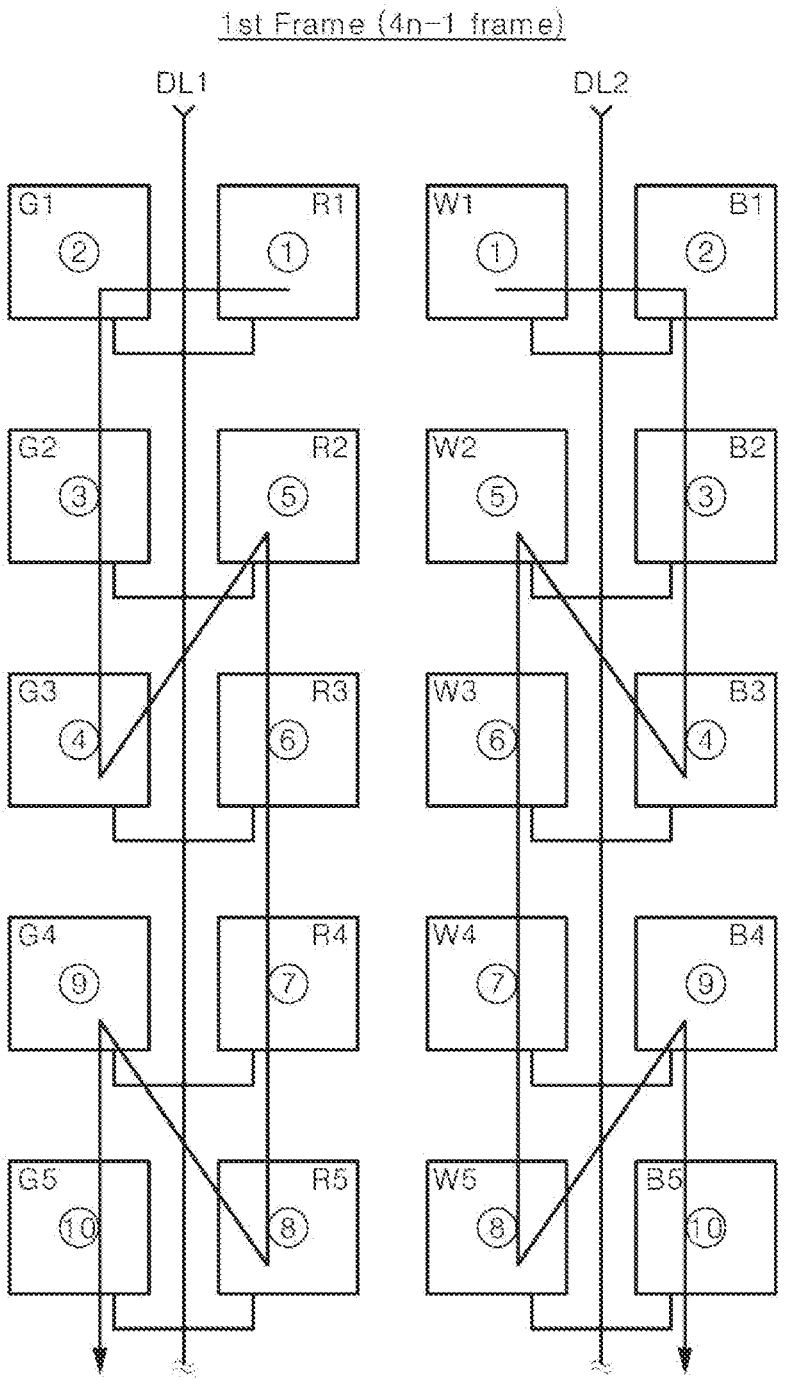
FIG. 13 is a pixel arrangement block diagram illustrating a driving order of pixels during a third frame period according to the second embodiment.

FIG. 13 is a pixel arrangement block diagram illustrating a driving order of pixels during a third frame period according to the second embodiment.

Referring to FIG. 13, the timing controller 500 allows a data voltage to be first supplied to pixels ① in the first pixel row of the even-numbered pixel columns ($2m^{th}$ pixel columns) and then to continue to be consecutively supplied to three same-colored pixels ②, ③, ④ in the first to third pixel rows of the odd-numbered pixel columns ($(2m-1)^{th}$ pixel columns) through the odd-numbered data lines ($(2m-1)^{th}$ data lines) during a third frame period that is the $(4n-1)^{th}$ frame periods. Additionally, the timing controller 500 can align image data (RGB) such that the data voltage continues to be supplied to four same-colored pixels ⑤, ⑥, ⑦, ⑧ in the second to fifth pixel rows of the even-numbered pixel columns ($2m^{th}$ pixel columns). Next, the timing controller 500 can align the image data (RGB) such that a data voltage continues to be supplied alternatively to every four same-colored pixels in the even-numbered pixel columns ($2m^{th}$ pixel columns) and the odd-numbered pixel columns ($(2m-1)^{th}$ pixel columns) from the four same-colored pixels ⑤, ⑥, ⑦, ⑧ in the second to fifth pixel rows of the even-numbered pixel columns ($2m^{th}$ pixel columns) in a way that the data voltage continues to be supplied again to four same-colored pixels ⑨, ⑩ in the fourth to seventh pixel rows of the odd-numbered pixel columns ($(2m-1)^{th}$ pixel columns).

In this case, the timing controller 500 can allow the data voltage to continue to be supplied consecutively to three same-colored pixels ②, ③, ④ in the first to third pixel rows of the even-numbered pixel columns ($2m^{th}$ pixel columns) after the data voltage is supplied first to pixels ① in the first pixel row of the odd-numbered pixel columns ($(2m-1)^{th}$ pixel columns) when it comes to the even-numbered data lines ($2m^{th}$ data lines). Additionally, the timing controller 500 can align the image data (RGB) such that the data voltage continues to be supplied to four same-colored pixels ⑤, ⑥, ⑦, ⑧ in the second to fifth pixel rows of the odd-numbered pixel columns ($(2m-1)^{th}$ pixel columns). Next, the timing controller 500 can align the image data such that the data voltage continues to be supplied alternatively to every four same-colored pixels in the odd-numbered pixel columns ($(2m-1)^{th}$ pixel columns) and the even-numbered pixel columns ($2m^{th}$ pixel columns) from the odd-numbered pixel columns ($(2m-1)^{th}$ pixel columns) in a way that the data voltage continues to be supplied again to four same-colored pixels ⑨, ⑩ in the fourth to seventh pixel rows of the even-numbered pixel columns ($2m^{th}$ pixel columns). The aligned image data can be supplied to the data driver 300 per at least 1 horizontal line.

In addition, the timing controller 500 can generate a gate control signal (GCS) and can transmit the same to the gate driver 200 such that a gate-on voltage is supplied to the entire gate lines (GL1 to GLn) in an order of $(8n-7)^{th}$ gate lines (GL(8n−7)), $(8n-6)^{th}$ gate lines (GL(8n−6)), $(8n-4)^{th}$ gate lines (GL(8n−4)), $(8n-2)^{th}$ gate lines (GL(8n−2)), $(8n-5)^{th}$ gate lines (GL(8n−5)), $(8n-3)^{th}$ gate lines (GL(8n−3)), $(8n-1)^{th}$ gate lines (GL(8n−1)), $(8n-7)^{th}$ gate lines (GL(8n−7)) and $8n^{th}$ gate lines (GL(8n)).

Accordingly, the gate driver 200 can supply the gate-on voltage to the entire gate lines (GL1 to GLn) in the order of $(8n-7)^{th}$ gate lines (GL(8n−7)), $(8n-6)^{th}$ gate lines (GL(8n−6)), $(8n-4)^{th}$ gate lines (GL(8n−4)), $(8n-2)^{th}$ gate lines (GL(8n−2)), $(8n-5)^{th}$ gate lines (GL(8n−5)), $(8n-3)^{th}$ gate lines (GL(8n−3)), $(8n-1)(^{th}$ gate lines (GL(8n−1)), $(8n-7)^{th}$ gate lines (GL(8n−7)) and $8n^{th}$ gate lines (GL(8n)) during the $(4n-1)^{th}$ frame periods.

The data driver 300 can convert the image data aligned by the timing controller 500 into a data voltage per 1 horizontal line, and during the $(4n-1)^{th}$ frame periods, can consecutively supply the data voltage to all of the odd-numbered and even-numbered data lines (DL1 to DLm) on the basis of a unit of 1 horizontal period in accordance with a timing of supply of the gate-on voltage to each gate line (GL1 to GLn).

As such, the data voltage can be supplied first to the pixels ① in the first pixel row of the even-numbered pixel columns ($2m^{th}$ pixel columns) and then can continue to be supplied consecutively to the three same-colored pixels ②, ③, ④ in the first to third pixel rows of the odd-numbered pixel columns ($(2m-1)^{th}$ pixel columns) through the odd-numbered data lines ($(2m-1)^{th}$ data lines). Additionally, the data voltage can continue to be supplied to the four same-colored pixels ⑤, ⑥, ⑦, ⑧ in the second to fifth pixel rows of the even-numbered pixel columns ($2m^{th}$ pixel columns), and in the way that the data voltage continues to be supplied again to the four same-colored pixels ⑨, ⑩ in the fourth to seventh pixel rows of the odd-numbered pixel columns ($(2m-1)^{th}$ pixel columns), the data voltage continues to be supplied alternatively to every four same-colored pixels in the even-numbered pixel columns ($2m^{th}$ pixel columns) and the odd-numbered pixel columns ($(2m-1)^{th}$ pixel columns) from the even-numbered pixel columns ($2m^{th}$ pixel columns).

At the same time, the data voltage can be supplied first to the pixels ① in the first pixel row of the odd-numbered pixel columns ((2m−1)$^{th}$ pixel columns), and then can continue to be supplied consecutively to the three same-colored pixels ②, ③, ④ in the first to third pixel rows of the even-numbered pixel columns (2m$^{th}$ pixel columns) when it comes to the even-numbered data lines (2m$^{th}$ data lines). Additionally, the data voltage can continue to be supplied to the four same-colored pixels ⑤, ⑥, ⑦, ⑧ in the second to fifth pixel rows of the odd-numbered pixel columns ((2m−1)$^{th}$ pixel columns), and in the way that the data voltage continues to be supplied again to the four same-colored pixels ⑨, ⑩ in the fourth to seventh pixel rows of the even-numbered pixel columns (2m$^{th}$ pixel columns), the data voltage can continue to be supplied alternatively to every four same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns).

During the third frame period that is the (4n−1)$^{th}$ frame periods, the timing controller 500, as described above, can allow the pixels (P), driven during the (4n−3)$^{th}$ frame periods, to operate in a driving order, i.e., in a way that 1 horizontal line is shifted.

Next, during a fourth frame period that is the 4n$^{th}$ frame periods, the timing controller 500 can allow the pixels (P), driven during the (4n−2)$^{th}$ frame periods, to operate in a driving order, i.e., in a way that 1 horizontal line is shifted.

Figure 14:
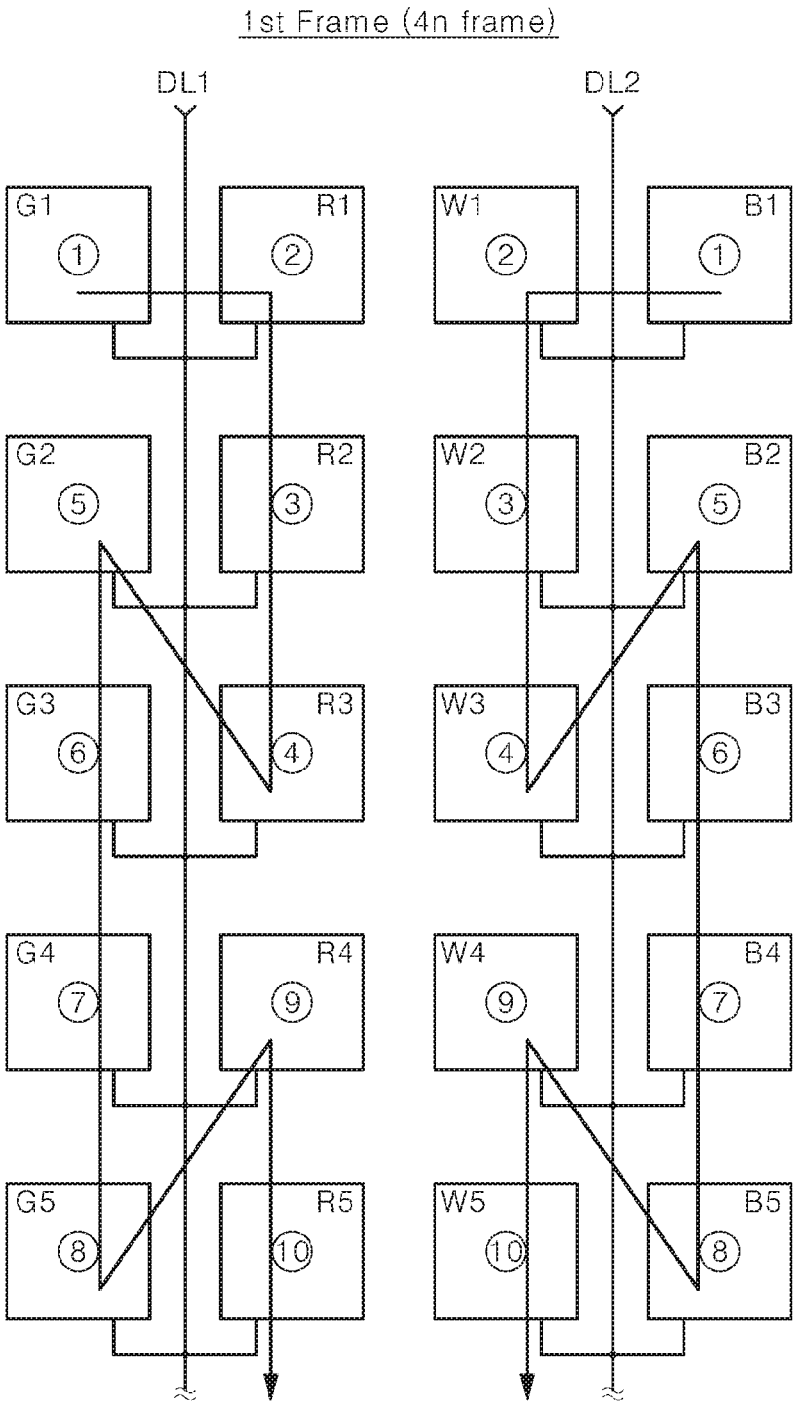
FIG. 14 is a pixel arrangement block diagram illustrating a driving order of pixels during a fourth frame period according to the second embodiment.

FIG. 14 is a pixel arrangement block diagram illustrating a driving order of pixels during a fourth frame period according to the second embodiment.

Referring to FIG. 14, unlike the timing controller in FIG. 13, the timing controller 500 can allow a data voltage to be first supplied to pixels ① in the first pixel row of the odd-numbered pixel columns ((2m−1)$^{th}$ pixel columns) connected to the odd-numbered data lines ((2m−1)$^{th}$ data lines) and then to continue to be consecutively supplied to three same-colored pixels ②, ③, ④ in the first to third pixel rows of the even-numbered pixel columns (2m$^{th}$ pixel columns) during the fourth frame period that is the 4n$^{th}$ frame periods. Additionally, the timing controller 500 can align image data (RGB) such that the data voltage continues to be supplied to four same-colored pixels ⑤, ⑥, ⑦, ⑧ in the second to fifth pixel rows of the odd-numbered pixel columns ((2m−1)$^{th}$ pixel columns). Next, the timing controller 500 can align the image data (RGB) such that the data voltage continues to be supplied alternatively to every four same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns) in a way that the data voltage continues to be supplied again to four same-colored pixels ⑨, ⑩ in the fourth to seventh pixel rows of the even-numbered pixel columns (2m$^{th}$ pixel columns).

The timing controller 500 can allow the data voltage to be supplied first to pixels ① in the first pixel row of the even-numbered pixel columns (2m$^{th}$ pixel columns), and then to continue to be supplied consecutively to three same-colored pixels ②, ③, ④ in the first to third pixel rows of the odd-numbered pixel columns ((2m−1)$^{th}$ pixel columns) when it comes to the even-numbered data lines (2m$^{th}$ data lines). Additionally, the timing controller 500 can align the image data (RGB) such that the data voltage can continue to be supplied to four same-colored pixels ⑤, ⑥, ⑦, ⑧ in the second to fifth pixel rows of the even-numbered pixel columns (2m$^{th}$ pixel columns). Next, the timing controller 500 can align the image data (RGB) such that the data voltage can continue to be supplied alternatively to every four same-colored pixels in the even-numbered pixel columns (2m$^{th}$ pixel columns) and the odd-numbered pixel columns ((2m−1)$^{th}$ pixel columns) from the four same-colored pixels ⑤, ⑥, ⑦, ⑧ in the second to fifth pixel rows of the even-numbered pixel columns (2m$^{th}$ pixel columns), in the way that the data voltage continues to be supplied again to four same-colored pixels ⑨, ⑩ in the fourth to seventh pixel rows of the odd-numbered pixel columns ((2m−1)$^{th}$ pixel columns). The aligned frame of image data can be supplied to the data driver 300 per at least 1 horizontal line.

In addition, the timing controller 500 can generate a gate control signal (GCS) and can transmit the same to the gate driver 200 such that a gate-on voltage is supplied to the entire gate lines (GL1 to GLn) 200 in an order of (8n−6)$^{th}$ gate lines (GL(8n−6)), (8n−7)$^{th}$ gate lines (GL(8n−7)), (8n−5)$^{th}$ gate lines (GL(8n−5)), (8n−3)$^{th}$ gate lines (GL(8n−3)), (8n−4)$^{th}$ gate lines (GL(8n−4)), (8n−2)$^{th}$ gate lines (GL(8n−2)), 8n$^{th}$ gate lines (GL(8n)), (8n−6)$^{th}$ gate lines (GL(8n−6)) and (8n−1)$^{th}$ gate lines (GL(8n−1)).

Accordingly, the gate driver 200 can supply the gate-on voltage to the entire gate lines (GL1 to GLn) in the order of (8n−6)$^{th}$ gate lines (GL(8n−6)), (8n−7)$^{th}$ gate lines (GL(8n−7)), (8n−5)$^{th}$ gate lines (GL(8n−5)), (8n−3)$^{th}$ gate lines (GL(8n−3)), (8n−4)$^{th}$ gate lines (GL(8n−4)), (8n−2)$^{th}$ gate lines (GL(8n−2)), 8n$^{th}$ gate lines (GL(8n)), (8n−6)$^{th}$ gate lines (GL(8n−6)) and (8n−1)$^{th}$ gate lines (GL(8n−1)) during the 4n$^{th}$ frame periods.

In this case, the data driver 300 can convert the image data aligned by the timing controller 500 into a data voltage per 1 horizontal line, and during the 4n$^{th}$ frame periods, can consecutively supply the data voltage to all of the odd-numbered and even-numbered data lines (DL1 to DLm) on the basis of a unit of 1 horizontal period in accordance with a timing of supply of the gate-on voltage to each gate line (GL1 to GLn).

As such, the data voltage can be supplied first to the pixels ① in the first pixel row of the odd-numbered pixel columns ((2m−1)$^{th}$ pixel columns) connected to the odd-numbered data lines ((2m−1)$^{th}$ data lines), and then can continue to be consecutively supplied to the three same-colored pixels ②, ③, ④ in the first to third pixel rows of the even-numbered pixel columns (2m$^{th}$ pixel columns). Additionally, the data voltage can continue to be supplied to the four same-colored pixels ⑤, ⑥, ⑦, ⑧ in the second to fifth pixel rows of the odd-numbered pixel columns ((2m−1)$^{th}$ pixel columns), and, in a way that the data voltage continues to be supplied again to the four same-colored pixels ⑨, ⑩ in the fourth to seventh pixel rows of the even-numbered pixel columns (2m$^{th}$ pixel columns), can continue to be supplied alternatively to every four same-colored pixels in the odd-numbered pixel columns ((2m−1)$^{th}$ pixel columns) and the even-numbered pixel columns (2m$^{th}$ pixel columns) from the odd-numbered pixel columns ((2m−1)$^{th}$ pixel columns).

At the same time, the data voltage can be supplied first to the pixels ① in the first pixel row of the even-numbered pixel columns (2m$^{th}$ pixel columns), and then can continue to be supplied consecutively to the three same-colored pixels ②, ③, ④ in the first to third pixel rows of the odd-numbered pixel columns ((2m−1)$^{th}$ pixel columns), through the even-numbered data lines (2m$^{th}$ data lines). Additionally, the data voltage can continue to be supplied to the four same-colored pixels ⑤, ⑥, ⑦, ⑧ in the second to fifth pixel rows of the even-numbered pixel columns (2m$^{th}$ pixel columns), and in the way that the data voltage continues to be supplied again to the four same-colored pixels ⑨, ⑩ in the fourth to seventh pixel rows of the odd-numbered pixel columns ((2m−1)$^{th}$ pixel columns), the data voltage can continue to be supplied alternatively to every four same-colored pixels in the even-numbered pixel columns (2m$^{th}$ pixel columns) and the odd-numbered pixel columns ((2m−1) pixel columns) from the even-numbered pixel columns (2m$^{th}$ pixel columns).

During the fourth frame period that is the 4n$^{th}$ frame periods, the timing controller 500, as described above, can allow the pixels (P), driven during the (4n−2)$^{th}$ frame periods, to operate in a driving order, i.e., in a way that 1 horizontal line is shifted while allowing each of the pixels (P) to operate in a driving order opposite to the driving order of the pixels (P) driven during the (4n−1)$^{th}$ frame periods.

According to the second embodiment described above, every four same-colored pixels arranged on the organic light emitting diode display panel 100 can alternatively continue to emit light, and the driving order of the pixels can be shifted on the basis of the unit of odd and even-numbered frame periods such that the pixels are driven. In this case, a change in data voltages supplied to each pixel through the data lines (DL1 to DLm), and a difference in data voltage charge rates between adjacent pixels can be further reduced.

The organic light emitting diode display device and the driving method thereof on the basis of the above-described embodiments can drive the organic light emitting diode display panel 100 according to the DRD method, thereby enabling the number of the data lines (DL1 to DLm) and the channels connected to the data lines to be halved and making the configuration of the data driver simple.

According to the present disclosure, the same-colored pixels (P) arranged on the organic light emitting diode display panel 100 can continue to emit light and the driving order of the pixels (P) can be shifted on the basis of the unit of at least one frame, thereby making it possible to reduce a change in data voltages supplied to each pixel (P) through the data lines (DL1 to DLm) and a difference in data voltage charge rates between adjacent pixels.

Particularly, the driving timing of each of the sub pixels can be changed and controlled such that the charge period (FT) the first sub pixels in need of improvement in a charge rate among the plurality of sub pixels preconfigured to continue to display the same color is lengthened. Accordingly, a difference in the charge rates of the sub pixels (P) can be reduced and a deterioration of image quality can be improved.

The present disclosure has been described with reference to the embodiments illustrated in the drawings. However, the disclosure is not limited to the embodiments and the drawings set forth herein. Further, various modifications can be made by one having ordinary skill in the art within the scope of the technical spirit of the disclosure. Further, though not explicitly described during description of the embodiments of the disclosure, effects and predictable effects based on the configuration of the disclosure should be included in the scope of the disclosure.

What is claimed is:

1. An organic light emitting diode display device, comprising:

an organic light emitting diode display panel where sub pixels adjacent to each other along a direction of a gate line among gate lines are paired and arranged to share a single data line among data lines in pixel areas defined by the gate lines and the data lines;

a timing controller configured to align and output image data so that same-colored sub pixels continue to emit light based on a unit of a plurality of predetermined horizontal periods, and to generate gate and data control signals so that a predetermined driving period of sub pixels is changed;

a gate driver configured to change an output period of gate-on signals according to the gate control signal, and to consecutively supply the gate-on signals with changed output period to the gate lines; and a data driver configured to generate a data voltage corresponding to the image data aligned by the timing controller, and to output the data voltage to each of the data lines so that the data voltage is synchronized with a timing of supply of the gate-on signal according to the data control signal.

2. The organic light emitting diode display device of claim 1, wherein for the organic light emitting diode display panel, the total number of all of the data lines is half the total number of entire pixel columns, and the total number of all of the gate lines is twice the total number of entire pixel rows, each pixel is disposed in a pixel area defined by two gate lines and a single data line that are crossed, and each pixel is paired with an adjacent pixel in the direction of the gate line and shares a single data line with the adjacent pixel.

3. The organic light emitting diode display device of claim 2, wherein pixels adjacent to each other in a direction of the data line respectively receive a gate-on signal from different gate lines, pixels in (4n−3)$^{th}$ pixel columns and pixels in 4n$^{th}$ pixel columns among pixels arranged in a same pixel row receive a gate-on signal from (2n−1)$^{th}$ gate lines that are odd-numbered gate lines closest to them, where n is a positive number, and pixels in (4n−2)$^{th}$ pixel columns and pixels in (4n−1)$^{th}$ pixel columns among pixels arranged in the same pixel row connect to receive a gate-on signal from 2m$^{th}$ gate lines that are even-numbered gate lines closest to them, where m is a positive number.

4. The organic light emitting diode display device of claim 1, wherein the timing controller is further configured to align the image data based on a unit of each frame and transmit the aligned image data to the data driver to allow a driving order of each of the sub pixels to be changed and to allow each of the sub pixels to be driven based on a unit of at least one frame while allowing same-colored sub pixels arranged along a direction of the data line to continue to emit light based on a plurality of horizontal periods.

5. The organic light emitting diode display device of claim 4, wherein the timing controller comprises:

a signal modulator configured to modulate a pulse width of a data enable signal, and to generate and output the modulated data enable signal so that a charge period of first sub pixels among a plurality of sub pixels preconfigured to continue to display a same color is lengthened by a predetermined period;

a line memory configured to align and output the image data so that the plurality of sub pixels preconfigured to continue to display the same color continues to emit light based on the unit of the plurality of horizontal periods while the plurality of sub pixels emits light according to a double rating driving (DRD) method;

a data control signal generator configured to generate the data control signal so that a charge period of the first sub pixels is lengthened by a predetermined period using a synchronization signal including the modulated data enable signal; and a gate control signal generator configured to generate a gate control signal so that a charge period of the first sub pixels is lengthened by a predetermined period using a synchronization signal including the modulated data enable signal.

6. The organic light emitting diode display device of claim 5, wherein the line memory is further configured to align the image data and consecutively transmit the aligned image data to the data driver so that an output period of image data displayed on the first sub pixels is lengthened based on the modulated data enable signal to lengthen a period of supply of a data voltage to the first sub pixels.

7. The organic light emitting diode display device of claim 5, wherein the line memory is further configured to align the image data based on the modulated data enable signal so that a period, during which the data voltage is supplied to the first sub pixels among the rest of the sub pixels preconfigured to continue to display the same color, is longer than a period during which the data voltage is supplied to the rest of the sub pixels configured to display the same color.

8. The organic light emitting diode display device of claim 5, wherein the line memory is further preconfigured to shorten a charge period of the rest of the sub pixels preconfigured to continue to display the same color except the first sub pixels configured to display the same color by a period that is calculated by dividing the lengthened charge period of the first sub pixels by the total number of the rest of the sub pixels and to output the aligned image data.

9. The organic light emitting diode display device of claim 5, wherein the data control signal generator is further configured to modulate an output width of a source output enable signal using the modulated data enable signal.

10. The organic light emitting diode display device of claim 5, wherein the gate control signal generator is further configured to modulate an output width of a gate output enable signal using the modulated data enable signal.

11. The organic light emitting diode display device of claim 5, wherein the signal modulator is configured to modulate a pulse width of the data enable signal and generate the modulated data enable signal so that a charge period of the rest of the sub pixels preconfigured to continue to display the same color except the first sub pixel is shortened by a period calculated by dividing the lengthened charge period of the first sub pixel by the total number of the rest of the sub pixels.

12. The organic light emitting diode display device of claim 5, wherein the signal modulator is further configured to modulate a pulse width of the data enable signal and to generate the modulated data enable signal so that a charge period of a first sub pixel among every two sub pixels configured to continue to display the same color is lengthened by a predetermined period versus a predetermined 1 horizontal period, and to modulate a pulse width of the data enable signal and to generate the modulated data enable signal so that a charge period of the rest of the sub pixels preconfigured to continue to display the same color except the first sub pixel is shortened by the lengthened charge period of the first sub pixel.

13. The organic light emitting diode display device of claim 5, wherein the signal modulator is further configured to modulate a pulse width of the data enable signal and to generate the modulated data enable signal so that a charge period of a first sub pixel among three or more sub pixels configured to continue to display the same color is lengthened by a predetermined period versus a predetermined 1 horizontal period, and to modulate a pulse width of the data enable signal and to generate the modulated data enable signal so that a charge period of the rest of the sub pixels preconfigured to continue to display the same color except the first sub pixel is shortened by a period calculated by dividing the lengthened charge period of the first sub pixel by the total number of the rest of the sub pixels.

14. The organic light emitting diode display device of claim 1, wherein the timing controller is further to align the image data so that the data voltage continues to be supplied to same-colored pixels in first and second pixel rows of odd-numbered pixel columns after the data voltage is supplied to pixels in a first pixel row of the even-numbered pixel columns connected to odd-numbered data lines, during even-numbered frame periods, to align the image data so that the data voltage continues to be supplied to same-colored pixels in second and third pixel rows of the even-numbered pixel columns and continues to be supplied again to same-colored pixels in third and fourth pixel rows of the odd-numbered pixel columns.

15. A diving method of an organic light emitting diode display device provided with an organic light emitting diode display panel where pixels adjacent to each other along a direction of a gate line are paired and arranged to share a single data line in pixel areas defined by a plurality of gate and data lines, the driving method comprising:

aligning and outputting image data so that same-colored sub pixels continue to emit light based on a unit of a plurality of predetermined horizontal periods, and generating and outputting gate and data control signals so that a predetermined driving period of sub pixels is changed;

changing an output period of gate-on signals according to the gate control signal, and to consecutively supply the output period to the gate lines; and generating a data voltage corresponding to the image data aligned by a timing controller, and outputting the data voltage to each of the data lines so that the data voltage is synchronized with a timing of supply of the gate-on signal according to the data control signal.

16. The driving method of claim 15, wherein the step of aligning and outputting image data, comprises aligning the image data based on a unit of each frame to allow a driving order of each of the sub pixels to be changed and to allow each of the sub pixels to be driven based on a unit of at least one frame while same-colored sub pixels arranged along a direction of the data line continues to emit light based on the unit of a plurality of horizontal periods.

17. The driving method of claim 16, wherein the step of aligning the image data based on a unit of each frame comprises aligning the image data in a line memory and consecutively transmitting the aligned image data to a data driver so that an output period of image data displayed on first sub pixels is lengthened based on a modulated data enable signal to lengthen a period of supply of a data voltage to the first sub pixels among same-colored sub pixels configured to continue to emit light.

18. The driving method of claim 17, wherein the step of generating gate and data control signals comprises modulating a pulse width of a data enable signal and generating the modulated data enable signal so that a charge period of all sub pixels configured to continue to display a same color except the first sub pixel is shortened by a period calculated by dividing a lengthened charge period of the first sub pixel by the total number of all sub pixels configured to continue to display the same color except the first sub pixel.

19. The driving method of claim 17, wherein the step of generating gate and data control signals comprises modulating a pulse width of a data enable signal and generating the modulated data enable signal so that a charge period of a first sub pixel among every two sub pixels configured to continue to display a same color is lengthened by a predetermined period versus a predetermined 1 horizontal period, and modulating a pulse width of the data enable signal and generating the modulated data enable signal so that a charge period of all sub pixels configured to continue to display the same color except the first sub pixel is shortened by the lengthened charge period of the first sub pixel.

20. The driving method of claim 17, wherein the step of generating gate and data control signals comprises modulating a pulse width of a data enable signal and generating the modulated data enable signal so that a charge period of a first sub pixel among three or more sub pixels configured to continue to display a same color is lengthened by a predetermined period versus a predetermined 1 horizontal period, and modulating a pulse width of the data enable signal and generating the modulated data enable signal so that a charge period of all sub pixels configured to continue to display the same color except the first sub pixel is shortened by a period calculated by dividing a lengthened charge period of the first sub pixel by the total number of the rest of the sub pixels.

* * * * *